US009709304B2

(12) United States Patent
Takenaka et al.

(10) Patent No.: US 9,709,304 B2
(45) Date of Patent: Jul. 18, 2017

(54) AIR-CONDITIONING APPARATUS

(75) Inventors: Naofumi Takenaka, Chiyoda-ku (JP); Shinichi Wakamoto, Chiyoda-ku (JP); Koji Yamashita, Chiyoda-ku (JP); Hiroyuki Morimoto, Chiyoda-ku (JP); Takeshi Hatomura, Chiyoda-ku (JP); Katsuhiro Ishimura, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 345 days.

(21) Appl. No.: 14/372,092

(22) PCT Filed: Jan. 23, 2012

(86) PCT No.: PCT/JP2012/000398
§ 371 (c)(1),
(2), (4) Date: Jul. 14, 2014

(87) PCT Pub. No.: WO2013/111176
PCT Pub. Date: Aug. 1, 2013

(65) Prior Publication Data
US 2014/0360218 A1 Dec. 11, 2014

(51) Int. Cl.
*F25B 41/00* (2006.01)
*F25B 30/02* (2006.01)
(Continued)

(52) U.S. Cl.
CPC ..... *F25B 30/02* (2013.01); *F25B 1/10* (2013.01); *F25B 13/00* (2013.01); *F25B 41/046* (2013.01);
(Continued)

(58) Field of Classification Search
CPC .... F25B 30/02; F25B 1/10; F25B 5/04; F25B 13/00; F25B 41/003; F25B 41/04;
(Continued)

(56) References Cited

U.S. PATENT DOCUMENTS 5,704,219 A * 1/1998 Suzuki ..... B60H 1/00907 237/2 B
2002/0134092 A1 9/2002 Matsuura
(Continued)

FOREIGN PATENT DOCUMENTS

JP 52-102968 U 8/1977
JP 4-222351 A 8/1992
(Continued)

OTHER PUBLICATIONS

Extended European Search Report issued Sep. 8, 2015 in Patent Application No. 12866917.3.
(Continued)

*Primary Examiner* — Len Tran
*Assistant Examiner* — Ana Vazquez
(74) *Attorney, Agent, or Firm* — Oblon, McClelland, Maier & Neustadt, L.L.P.

(57) ABSTRACT

An air-conditioning apparatus includes an outdoor-side flow rate control device (a fourth flow rate control device) that generates an intermediate pressure for injection into a compressor, and a bypass flow rate control device (a sixth flow rate control device) that is placed at a bypass pipe allowing bypassing of an outdoor heat exchanger in parallel to the outdoor-side flow rate control device and that controls the amount of heat exchange of the outdoor heat exchanger together with the outdoor-side flow rate control device.

17 Claims, 19 Drawing Sheets

(51) Int. Cl.

| | |
|---|---|
| ***F25B 13/00*** | (2006.01) |
| ***F25B 41/04*** | (2006.01) |
| ***F25B 1/10*** | (2006.01) |

(52) U.S. Cl.
CPC ... *F25B 2313/005* (2013.01); *F25B 2313/006* (2013.01); *F25B 2313/0233* (2013.01); *F25B 2313/0272* (2013.01); *F25B 2313/02741* (2013.01); *F25B 2400/13* (2013.01); *F25B 2600/2509* (2013.01); *F25B 2700/1931* (2013.01); *F25B 2700/21152* (2013.01)

(58) Field of Classification Search
CPC .. F25B 41/062; F25B 45/00; F25B 2313/005; F25B 2313/023; F25B 2313/0231; F25B 2313/0233; F25B 2313/027; F25B 2313/0272; F25B 2313/02741; F25B 2400/0401; F25B 2500/24; F25B 2700/21152; F25B 41/046; F25B 2313/006; F25B 2400/13; F25B 2600/2509; F25B 2700/1931
See application file for complete search history.

(56) References Cited

U.S. PATENT DOCUMENTS

| | | | | |
|---|---|---|---|---|
| 2003/0167780 | A1* | 9/2003 | Domyo | C09K 5/045 62/114 |
| 2006/0053823 | A1 | 3/2006 | Taras et al. | |
| 2007/0283712 | A1 | 12/2007 | Taras et al. | |
| 2009/0071177 | A1* | 3/2009 | Unezaki | F25B 13/00 62/196.1 |

FOREIGN PATENT DOCUMENTS

| | | | | |
|---|---|---|---|---|
| JP | 9 126574 | | 5/1997 | |
| JP | 9 229506 | | 9/1997 | |
| JP | 2001 227827 | | 8/2001 | |
| JP | 2007 263443 | | 10/2007 | |
| JP | 2008 513725 | | 5/2008 | |
| JP | 2009 138693 | | 6/2009 | |
| JP | 2009 198099 | | 9/2009 | |
| JP | 2009198099 | A * | 9/2009 | F25B 2313/0231 |
| JP | 2010 2074 | | 1/2010 | |
| JP | 2010 139205 | | 6/2010 | |

OTHER PUBLICATIONS

Office Action issued May 12, 2015 in Japanese Patent Application No. 2013-554982 (with English language translation).
International Search Report Issued Feb. 21, 2012 in PCT/JP12/000398 Filed Jan. 23, 2012.
Combined Office Action and Search Report issued Jul. 28, 2015 in Chinese Patent Application No. 201280067172.X (with English language translation and English translation of categories of cited documents).
European Office Action issued in Application No. 12 866 917.3 on Apr. 7, 2017.

* cited by examiner

AIR-CONDITIONING APPARATUS

TECHNICAL FIELD

The present invention relates to an air-conditioning apparatus that performs cooling and heating using a refrigeration cycle and, more particularly, to an air-conditioning apparatus in which a plurality of indoor units are capable of individually performing heating and cooling and which improves the usability of a compressor into which a refrigerant is able be injected in the course of a compression process.

BACKGROUND ART

Air-conditioning apparatuses have been available in which a plurality of indoor units are connected to one or more outdoor units and which is capable of performing a cooling operation in which each indoor unit performs cooling only, a heating operation in which each indoor unit performs heating only, and a mixed operation in which indoor units perform cooling and heating simultaneously. In such an air-conditioning apparatus, for heating when the outside air has a low temperature, in general, the suction density of a compressor decreases, and the flow rate of refrigerant and the heating capacity decrease. Thus, the heating capacity may be increased by injecting a refrigerant in the course of a compression process by the compressor. For example, Patent Literature 1 describes a refrigerant circuit of a cooling and heating simultaneous air-conditioning apparatus including a compressor which allows injection.

Furthermore, in recent years, in view of global environmental protection, as a refrigerant to be used for air conditioning, switching from a currently-used refrigerant having a high global warming potential (GWP), such as an R410 refrigerant, an R407C refrigerant, or an R134a refrigerant, to a refrigerant having a low GWP, such as a carbon dioxide refrigerant, an ammonia refrigerant, a hydrocarbon-based refrigerant, a tetrafluoropropane (HFO)-based refrigerant, or a difluoromethane (R32) refrigerant, is in progress. Among the refrigerants having low GWP, an R32 refrigerant has substantially the same evaporating and condensing pressures as an R410A refrigerant and has a refrigeration capacity per unit mass and volume greater than the R410A refrigerant. Therefore, with the R32 refrigerant, the apparatus can be downsized.

Thus, adoption of an R32 refrigerant or a mixture of an R32 refrigerant and an HFO refrigerant or the like has been regarded as being promising. However, the R32 refrigerant has a property of making a compressor have a smaller suction density and a higher discharge temperature than the R410A refrigerant. For example, in the case where the evaporating temperature is 5 degrees Centigrade, the condensing temperature is 45 degrees Centigrade, and the degree of superheat of refrigerant at the time of suction of the compressor is 1 degree Centigrade, the discharge temperature of the R32 refrigerant rises by about 20 degrees Centigrade compared to the R410A refrigerant. The upper limit of the discharge temperature of a compressor is determined based on the guarantee temperature of refrigerating machine oil, sealing material, or the like. In the case where switching to an R32 refrigerant or a refrigerant mixture containing an R32 refrigerant as a component is made, it is necessary to take measures to lower the discharge temperature. Thus, lowering the discharge temperature by injection is effective.

CITATION LIST

Patent Literature

Patent Literature 1: Japanese Unexamined Patent Application Publication No. 2009-198099 ([0044]-[0064], FIG. 1 etc.)

SUMMARY OF INVENTION

Technical Problem

In the air-conditioning apparatus described in Patent Literature 1, a refrigerant circuit configuration capable of a cooling and heating simultaneous operation includes an intermediate-pressure control device for providing an injection function (a heat-source-unit-side flow-rate control device 135), an injection pipe (an injection pipe 161), and an injection flow rate control device (an injection flow rate control device 163). However, in the air-conditioning apparatus described in Patent Literature 1, heat exchange amount control devices (a heat-source-unit-side first solenoid opening and closing valve 132 and a heat-source-unit-side second solenoid opening and closing valve 133) for adjusting the amount of heat exchange of an outdoor heat exchanger are connected in series with the intermediate-pressure control device, and this poses a problem that the cooling and heating performance is lowered due to pressure loss of these devices and the aperture of the valves is increased in order to prevent the pressure loss from increasing.

The present invention has been made in order to solve the problem described above, and has as its object to implement an air-conditioning apparatus capable of stably performing heat exchange amount control of an outdoor heat exchanger and injection control even if the load conditions change, and capable of operating in a state of high efficiency while maintaining the reliability of a compressor by lowering the discharge temperature.

Solution to Problem

An air-conditioning apparatus according to the present invention includes a compressor into which an intermediate-pressure refrigerant is allowed to be injected via an injection pipe in the course of compressing a refrigerant; an outdoor heat exchanger; a flow passage switching device that switches connection of the outdoor heat exchanger; an injection flow rate control device that controls the flow rate of injection into the compressor; an outdoor-side flow rate control device that generates an intermediate pressure for injection into the compressor; a bypass flow rate control device that is placed at a bypass pipe which allows bypassing of the outdoor heat exchanger in parallel to the outdoor-side flow rate control device and that controls the amount of heat exchange of the outdoor heat exchanger together with the outdoor-side flow rate control device; an indoor heat exchanger; and an indoor-side flow rate control device that adjusts the flow rate of refrigerant to the indoor heat exchanger. The compressor, the outdoor heat exchanger, the flow passage switching device, the injection flow rate control device, the outdoor-side flow rate control device, and the bypass flow rate control device are provided within an outdoor unit. The indoor heat exchanger and the indoor-side flow rate control device are provided within an indoor unit. The indoor unit includes a plurality of indoor units, which are connected to the outdoor unit in parallel.

Advantageous Effects of Invention

With an air-conditioning apparatus according to the present invention, since an outdoor-side flow rate control device and a bypass flow rate control device are connected in parallel, a compressor is able to operate with high reliability upon lowering the discharge temperature of refrigerant discharged from the compressor, and at the same time, perform an efficient operation corresponding to the indoor load.

DESCRIPTION OF EMBODIMENTS

Embodiments of the present invention will be described hereinafter with reference to the drawings.

Embodiment 1

Figure 1:
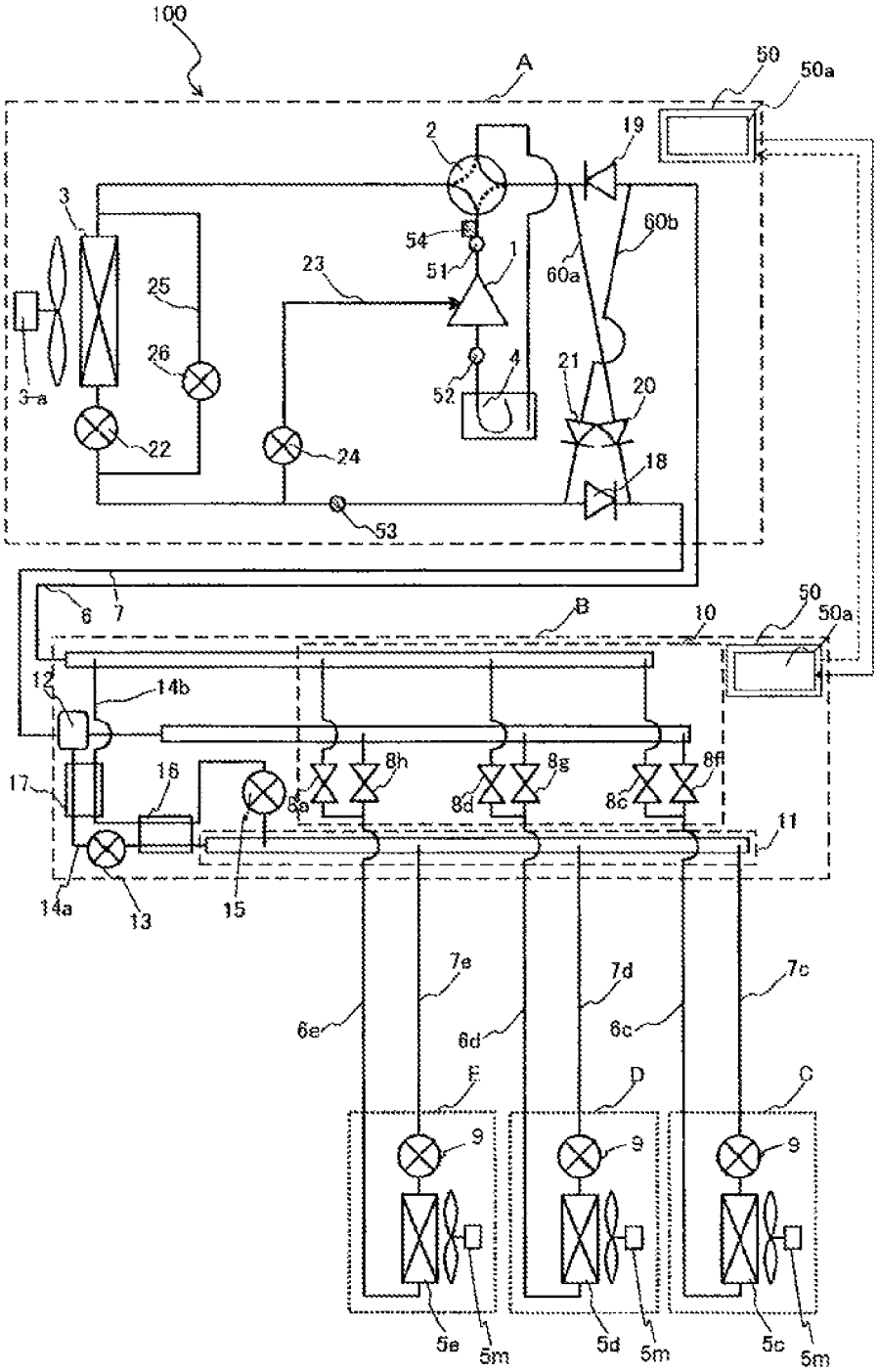
FIG. 1 is a refrigerant circuit diagram illustrating an example of the refrigerant circuit configuration of an air-conditioning apparatus according to Embodiment 1 of the present invention.

FIG. 1 is a refrigerant circuit diagram illustrating an example of the refrigerant circuit configuration of an air-conditioning apparatus 100 according to Embodiment 1 of the present invention. The circuit configuration of the air-conditioning apparatus 100 will be explained with reference to FIG. 1. In the air-conditioning apparatus, individual indoor units are capable of freely selecting a cooling mode or a heating mode by using a refrigeration cycle. In the drawings provided below including FIG. 1, the size relationship of individual components may be different from the actual size relationship.

Referring to FIG. 1, the air-conditioning apparatus 100 includes an outdoor unit (heat source unit) A, a plurality of indoor units C to E connected in parallel, and a relay unit B arranged between the outdoor unit A and the indoor units C to E. In Embodiment 1, the case where one relay unit and three indoor units are connected to one heat source unit will be explained. However, the illustration is not intended to limit the number of the units connected. For example, two or more heat source units, two or more relay units, and two or more indoor units may be connected.

The outdoor unit A and the relay unit B are connected by a first refrigerant pipe 6 and a second refrigerant pipe 7. The relay unit B and the indoor units C to E are connected by first indoor-unit-side refrigerant pipes 6*c* to 6*e* on the indoor unit side and second indoor-unit-side refrigerant pipes 7*c* to 7*e* on the indoor unit side.

The first refrigerant pipe 6 is a large-diameter pipe connecting a four-way switching valve 2 with the relay unit B. The first indoor-unit-side refrigerant pipes 6*c* to 6*e* on the indoor unit side connect indoor heat exchangers 5*c* to 5*e* of the indoor units C to E with the relay unit B and branch off from the first refrigerant pipe 6. The second refrigerant pipe 7 has a diameter smaller than the first refrigerant pipe 6 and connects an outdoor heat exchanger 3 with the relay unit B. The second indoor-unit-side refrigerant pipes 7*c* to 7*e* on the indoor unit side are for the indoor heat exchangers 5*c* to 5*e* of the indoor units C to E and the relay unit B together and branch off from the second refrigerant pipe 7.

[Outdoor Unit A]

The outdoor unit A is typically positioned in a space (for example, a rooftop or the like) outside a construction such as a building, and supplies cooling energy or heating energy to the indoor units C to E via the relay unit B. However, the outdoor unit A need not always be installed outdoors. For example, the outdoor unit A may be installed in an enclosed space such as a machine room with air vents. The outdoor unit A may be installed inside a construction as long as waste heat can be exhausted outside the construction via an exhaust duct. Alternatively, a water-cooled outdoor unit A may be installed inside a construction. Wherever the outdoor unit A is installed, there will be no particular problem.

The outdoor unit A includes a compressor 1 to which an intermediate-pressure refrigerant is allowed to be injected in the process of compressing a low-pressure refrigerant into a high-pressure refrigerant, a four-way switching valve 2 serving as a flow passage switching device that switches the direction in which the refrigerant circulates in the outdoor unit A, an outdoor heat exchanger 3, and an accumulator 4. The above-mentioned components are connected by the first refrigerant pipe 6 and the second refrigerant pipe 7.

In the vicinity of the outdoor heat exchanger 3, a flow rate control device 3-*a* for controlling the flow rate of fluid that exchanges heat with refrigerant is installed. An air-cooled outdoor heat exchanger 3 will be explained hereinafter as an example of the outdoor heat exchanger 3 and an outdoor fan as the flow rate control device 3-*a* will be explained as an example of the flow rate control device 3-*a*. However, a different type, such as the water-cooled type (in this case, the flow rate control device 3-*a* is a pump), may be used as long as the refrigerant exchanges heat with a different fluid. In addition, a method for controlling the compressor 1 and the outdoor fan 3-*a*, and a method for switching the four-way switching valve 2 will be described later.

Furthermore, the outdoor unit A includes a first connecting pipe 60*a*, a second connecting pipe 60*b*, and check valves 18, 19, 20, and 21. By providing the first connecting pipe 60*a*, the second connecting pipe 60*b*, and the check valves 18, 19, 20, and 21, a high-pressure refrigerant flows out of the outdoor unit A via the second refrigerant pipe 7 and a low-pressure refrigerant flows into the outdoor unit A via the first refrigerant pipe 6, regardless of the connecting direction of the four-way switching valve 2.

The compressor 1 sucks and compresses a heat-source-side refrigerant into a high-temperature and high-pressure state, and may be configured as, for example, a capacity-controllable inverter compressor or the like. The compressor 1 need only be of a type into which an intermediate-pressure refrigerant is allowed to be injected. The compressor 1 may be of any type, such as a type in which an intermediate-pressure refrigerant is directly injected into the refrigerant being compressed within a compression chamber of a single compressor, a type in which an intermediate-pressure refrigerant is merged with a refrigerant that is discharged from a lower-stage-side compression chamber of a two-stage compressor or two compressors and that is to be sucked into a higher-stage-side compression chamber.

The four-way switching valve 2 performs switching between the flow of the heat-source-side refrigerant at the time of a heating operation and the flow of the refrigerant at the time of a cooling operation. The outdoor heat exchanger (heat-source-unit-side heat exchanger) 3 functions as an evaporator during a heating operation and functions as a condenser (or a radiator) during a cooling operation, exchanges heat between air supplied from the outdoor fan 3-*a* and the heat-source-side refrigerant, and transforms the heat-source-side refrigerant into vapor or condensate. The accumulator 4 is provided on the suction side of the compressor 1, and stores excess refrigerant generated due to the difference between a heating operation and a cooling operation or excess refrigerant generated upon a transient change in operation.

The check valve 18 is provided at the second refrigerant pipe 7 between the outdoor heat exchanger 3 and the relay unit B, and allows the heat-source-side refrigerant to flow only in a predetermined direction (the direction from the outdoor unit A to the relay unit B). The check valve 19 is provided at the first refrigerant pipe 6 between the relay unit B and the four-way switching valve 2, and allows the heat-source-side refrigerant to flow only in a predetermined direction (the direction from the relay unit B to the outdoor unit A). The check valve 20 is provided at the first connecting pipe 60*a*, and causes the heat-source-side refrigerant discharged from the compressor 1 to circulate to the relay unit B during a heating operation. The check valve 21 is provided at the second connecting pipe 60*b*, and causes the heat-source-side refrigerant returned from the relay unit B to circulate to the suction side of the compressor 1 during a heating operation.

The first connecting pipe 60*a* allows connection between the first refrigerant pipe 6 positioned between the four-way switching valve 2 and the check valve 19, and the second refrigerant pipe 7 positioned between the check valve 18 and the relay unit B, within the outdoor unit A. The second connecting pipe 60*b* allows connection between the first refrigerant pipe 6 positioned between the check valve 19 and the relay unit B, and the second refrigerant pipe 7 positioned between the outdoor heat exchanger 3 and the check valve 18, within the outdoor unit A.

Furthermore, the outdoor unit A includes pressure gauges 51, 52, and 53 and a thermometer 54. The pressure gauge 51 is provided on the discharge side of the compressor 1, and measures the pressure of the refrigerant discharged from the compressor 1. The pressure gauge 52 is provided on the suction side of the compressor 1, and measures the pressure of the refrigerant sucked into the compressor 1. The pressure gauge 53 is provided on the upstream side of the check valve 18, and measures the pressure, intermediate pressure, of the refrigerant on the upstream side of the check valve 18. The thermometer 54 is provided on the discharge side of the compressor 1, and measures the temperature of the refrigerant discharged from the compressor 1. The pieces of information (temperature information and pressure information) detected by these detection devices are sent to a controller (for example, a controller 50) that performs overall control of the operation of the air-conditioning apparatus 100, and are used to control individual actuators.

Furthermore, the outdoor unit A includes a fourth flow rate control device (outdoor-side flow rate control device) 22, an injection pipe 23, a fifth flow rate control device (injection flow rate control device) 24, a third bypass pipe 25, and a sixth flow rate control device (bypass flow rate control device) 26.

The fourth flow rate control device 22 is provided between the outdoor heat exchanger 3, and the check valve 21 and the check valve 18, and is configured to be freely openable and closable. The fourth flow rate control device 22 exhibits a function of generating an intermediate pressure of refrigerant to be injected into the compressor 1. The injection pipe 23 is provided to inject an intermediate-pressure refrigerant into the compressor 1. The injection pipe 23 branches off from the second refrigerant pipe 7 positioned between the fourth flow rate control device 22 and the check valves 21 and 18, and is connected to an injection port (not illustrated) of the compressor 1.

The fifth flow rate control device 24 is provided in the middle of the injection pipe 23 and is configured to be freely openable and closable. With the fifth flow rate control device 24, the flow rate of refrigerant to be injected into the compressor 1 is adjusted. The third bypass pipe 25 is provided for allowing bypassing of the outdoor heat exchanger 3. The sixth flow rate control device 26 is provided in the middle of the third bypass pipe 25 and is configured to be freely openable and closable. With the sixth flow rate control device 26, the flow rate of refrigerant to flow into the outdoor heat exchanger 3 is adjusted.

The air-conditioning apparatus 100 also includes the controller 50. Although a detailed explanation of the controller 50 will be given later, the controller 50 controls driving of the compressor 1, switching of the four-way switching valve 2, driving of a fan motor for the outdoor fan 3-*a*, the opening degrees of flow rate control devices (first to fifth flow rate control devices), and driving of fan motors for indoor fans 5-*m*, on the basis of pieces of information (refrigerant pressure information, refrigerant temperature information, outdoor temperature information, and indoor temperature information) detected by various detection devices provided in the air-conditioning apparatus 100. The controller 50 includes a memory 50*a* which stores functions and the like for determining control values.

[Relay Unit B]

The relay unit B is installed in, for example, a space such as a space above a ceiling, which falls inside a construction but is different from an indoor space, and transfers, to the indoor units C to E, cooling energy or heating energy supplied from the outdoor unit A. However, the relay unit B may be installed in a shared space in which an elevator or the like is installed, or the like.

The relay unit B includes a first branch portion 10, a second branch portion 11, a gas-liquid separator 12, a first bypass pipe 14*a*, a second bypass pipe 14*b*, a second flow rate control device 13, a third flow rate control device 15, a first heat exchanger 17, a second heat exchanger 16, and a controller 50. The controller 50 has a configuration and function similar to those of the controller 50 in the outdoor unit A.

The first branch portion 10 corresponds to the indoor units C to E and allows the first indoor-unit-side refrigerant pipes 6*c* to 6*e* on the indoor unit side to be switchably connected to the first refrigerant pipe 6 or the second refrigerant pipe 7. The first branch portion 10 is provided with solenoid valves 8*c* to 8*h* installed at the first indoor-unit-side refrigerant pipes 6*c* to 6*e* on the indoor unit side. The first indoor-unit-side refrigerant pipes 6*c* to 6*e* on the indoor unit side branch off at the first branch portion 10. One set of the split pipes of the first indoor-unit-side refrigerant pipes 6*c* to 6*e* is connected to the first refrigerant pipe 6 via the solenoid valves 8*c* to 8*e*, while the other set of the split pipes of the first indoor-unit-side refrigerant pipes 6*c* to 6*e* is connected to the second refrigerant pipe 7 via the solenoid valves 8*f* to 8*h*.

By controlling opening and closing of the solenoid valves 8*c* to 8*h*, the solenoid valves 8*c* to 8*h* allow the first indoor-unit-side refrigerant pipes 6*c* to 6*e* on the indoor unit side to be switchably connected to the first refrigerant pipe 6 or the second refrigerant pipe 7. The solenoid valves 8*c* and 8*f* placed at the first indoor-unit-side refrigerant pipe 6*c* on the indoor unit side, the solenoid valves 8*d* and 8*g* placed at the first refrigerant pipe 6*d* on the indoor unit side, and the solenoid valves 8*e* and 8*h* placed at the first refrigerant pipe 6*e* on the indoor unit side will be referred to as first solenoid valves, second solenoid valves, and third solenoid valves, respectively.

The second branch portion 11 corresponds to the indoor units C to E and connects the second refrigerant pipes 7*c* to 7*e* on the indoor unit side to the first bypass pipe 14*a* and the second bypass pipe 14*b* within the relay unit B (to be described later). The second branch portion 11 includes the junctions of the first bypass pipe 14*a* and the second bypass pipe 14*b*. The gas-liquid separator 12 is provided in the middle of the second refrigerant pipe 7, and separates the refrigerant flowing in it via the second refrigerant pipe 7 into a gas and a liquid. Then, a gas-phase component separated by the gas-liquid separator 12 flows into the first branch portion 10, and a liquid-phase component separated by the gas-liquid separator 12 flows into the second branch portion 11.

The first bypass pipe 14*a* connects the gas-liquid separator 12 and the second branch portion 11 together within the relay unit B. The second bypass pipe 14*b* connects the second branch portion 11 and the first refrigerant pipe 6 together within the relay unit B. The second flow rate control device 13 is provided in the middle of the first bypass pipe 14*a* and is configured to be freely openable and closable. The third flow rate control device 15 is provided in the middle of the second bypass pipe 14*b* and is configured to be freely openable and closable.

The first heat exchanger 17 is provided to exchange heat between the refrigerant flowing between the gas-liquid separator 12 and the second flow rate control device 13 at the first bypass pipe 14*a*, and the refrigerant flowing between the third flow rate control device 15 and the first refrigerant pipe 6 at the second bypass pipe 14*b*. The second heat exchanger 16 is provided to exchange heat between the refrigerant flowing between the second flow rate control device 13 and the second branch portion 11 at the first bypass pipe 14*a*, and the refrigerant flowing between the third flow rate control device 15 and the first heat exchanger 17 at the second bypass pipe 14*b*.

A flow passage switching valve, such as a check valve, may be arranged at the second branch portion 11, so that the refrigerant flowing from an indoor unit performing heating into the second branch portion 11 flows into the second heat exchanger 16. In this case, since the refrigerant at the input of the third flow rate control device 15 reliably becomes a single-phase liquid refrigerant, stable flow rate control can be done.

[Indoor Units C to E]

Each of the indoor units C to E is installed at the position from which conditioned air can be supplied to an air-conditioned space, such as an indoor space, and supplies cooling air or heating air to the air-conditioned space using cooling energy or heating energy from the outdoor unit A transferred via the relay unit B. The indoor units C to E each include an indoor heat exchanger 5 and a first flow rate control device (indoor-unit-side flow rate control device) 9.

Furthermore, in the vicinity of the indoor heat exchangers 5, flow rate control devices 5-*m* for controlling the flow rates of fluid which exchanges heat with the refrigerant are installed. Here, an explanation will be provided in which air-cooled indoor heat exchangers 5 are an example of the indoor heat exchangers 5 and indoor fans 5-*m* are an example of the flow rate control devices 5-*m*. However, a different type, such as the water-cooled type (in this case, the flow rate control devices 5-*m* are pumps), may be used as long as the refrigerant exchanges heat with a different fluid.

The indoor heat exchangers 5 exchange heat between air supplied from air-sending devices for the indoor fans 5-*m* and a heat medium to generate heating air or cooling air to be supplied to an air-conditioned space. The first flow rate control devices 9 are provided between the second branch portion 11 of the relay unit B and the indoor heat exchangers 5, and are configured to be freely openable and closable. The first flow rate control devices 9 adjust the flow rates of refrigerant flowing into the indoor heat exchangers 5.

[Characteristic Configuration of Air-Conditioning Apparatus 100]

Conventionally, as described in Patent Literature 1 described above, the amount of heat exchange of an outdoor heat exchanger is generally controlled by dividing the heat exchanger, installing an opening and closing valve, such as a solenoid valve, at each of the heat exchangers, and changing the heat transfer areas of the heat exchangers by opening and closing the opening and closing valves. In contrast, in the air-conditioning apparatus 100, heat exchange amount control of the outdoor heat exchanger is performed by using devices capable of continuously changing the flow passage resistance for the fourth flow rate control device 22 that controls the intermediate pressure for injection and the sixth flow rate control device 26 that controls the amount of heat exchange of the outdoor heat exchanger 3, and adjusting the flow rate of refrigerant flowing into the outdoor heat exchanger 3.

With this configuration, the fourth flow rate control device 22 and the sixth flow rate control device 26 can be arranged in parallel. That is, in the air-conditioning apparatus 100, since the fourth flow rate control device 22 and the sixth flow rate control device 26 are connected in parallel, pressure loss of refrigerant can be reduced to allow an operation with high efficiency. Simply, as the sixth flow rate control device 26, a capillary pipe or the like and a solenoid valve can be connected in series, so that the flow rate is adjusted by opening and closing of the solenoid valve.

[Case where Injection into Compressor 1 is Required]

Figure 2:
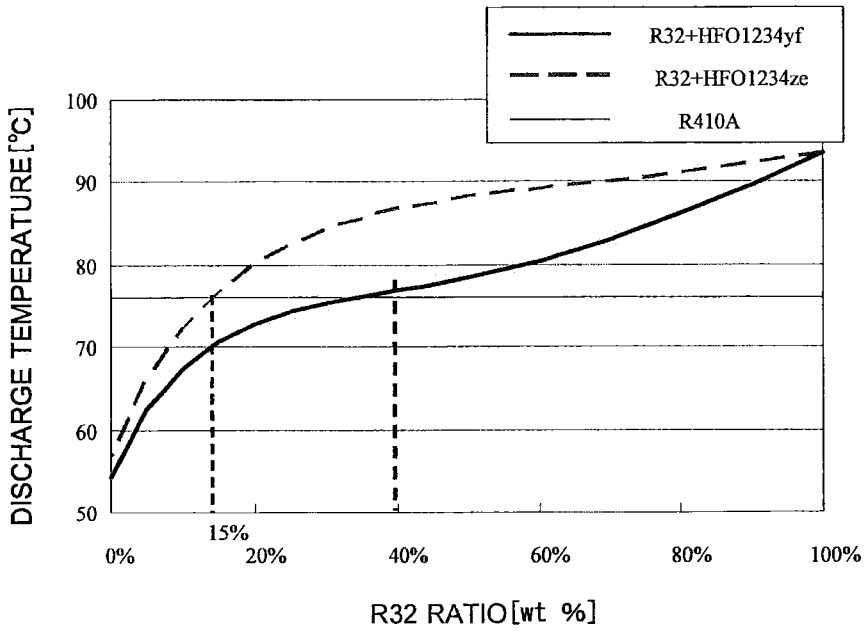
FIG. 2 illustrates the calculation results of discharge temperature for R410A and the ratios of R32 in a refrigerant mixture of R32 and HFO1234yf and a refrigerant mixture of R32 and HFO1234ze.

FIG. 2 illustrates the calculation results of discharge temperature for R410A and the ratios of R32 in a refrigerant mixture of R32 and HFO1234yf and a refrigerant mixture of R32 and HFO1234ze. The case where injection into the compressor 1 is required will be discussed with reference to FIG. 2. Referring to FIG. 2, the horizontal axis represents the ratio of R32 [wt %] and the vertical axis represents the discharge temperature [degrees Centigrade]. In addition, it is assumed that the evaporating temperature of compressor suction is 5 degrees Centigrade, the condensing temperature is 45 degrees Centigrade, the suction SH is 3 degrees Centigrade, and the adiabatic efficiency of the compressor 1 is 65%.

First, during heating when the outside air has a low temperature, the density of refrigerant sucked into the compressor 1 decreases, and the flow rate of the refrigerant within the circuit decreases. With the decrease in flow rate of the refrigerant, the heating capacity decreases. Therefore, in this case, it is effective to increase the flow rate of refrigerant and increase the heating capacity by injection. A change in discharge temperature which depends on the type of refrigerant used will be considered next. When the discharge temperature of refrigerant rises, a sealing material of the compressor 1 and refrigerating machine oil deteriorate and the stability of the refrigerant degrades. Therefore, the discharge temperature is required to be kept at, for example, about 120 degrees Centigrade or below.

As is clear from FIG. 2, in the case where an R32 refrigerant is used as a simple substance, the discharge temperature rises by about 20 degrees Centigrade compared to the case of R410A. According to the calculation conditions, the discharge temperature does not exceed 120 degrees Centigrade. However, if an operation at a high compression ratio of the compressor 1, such as a heating operation when the outside air has a low temperature or a cooling operation when the outside air has a high temperature, is performed, 120 degrees Centigrade may be exceeded.

As is clear from FIG. 2, in order to achieve unit design with a level of reliability equal to that of R410A, it is necessary to take measures to lower the discharge temperature when R32 has 40 wt % or more in the case of a refrigerant mixture of R32 and HFO1234yf and when R32 has 15 wt % or more in the case of a refrigerant mixture of R32 and HFO1234yf. Here, it is effective to cool the refrigerant in the process of being compressed by injection into it. When the tolerance of rise is about 5 degrees Centigrade with respect to R410A, R32 occupies 60 wt % or more in the case of the refrigerant mixture of R32 and HFO1234yf, and R32 occupies 25 wt % or more in the case of the refrigerant mixture of R32 and HFO1234yf.

[Operation Modes]

Various operations performed by the air-conditioning apparatus 100 will be explained next. The running operations of the air-conditioning apparatus 100 include four modes: a cooling operation, a heating operation, a cooling main operation, and a heating main operation.

A cooling operation is an operation mode in which an indoor unit is capable of performing only cooling and the indoor unit is performing cooling or is stopped. A heating operation is an operation mode in which an indoor unit is capable of performing only heating and the indoor unit is performing heating or is stopped. A cooling main operation is an operation mode in which each indoor unit is capable of selecting cooling or heating, the cooling load is greater than the heating load, and the outdoor heat exchanger 3 is connected to the discharge side of the compressor 1 and operates as a condenser (radiator). A heating main operation is an operation mode in which each indoor unit is capable of selecting cooling or heating, the heating load is greater than the cooling load, and the outdoor heat exchanger 3 is connected to the suction side of the compressor 1 and operates as an evaporator. The flow of refrigerant in the individual operation modes when injection is not performed and when injection is performed will be explained hereinafter with reference to P-h diagrams.

[Cooling Operation: Case where Injection is not Performed]

Figure 3:
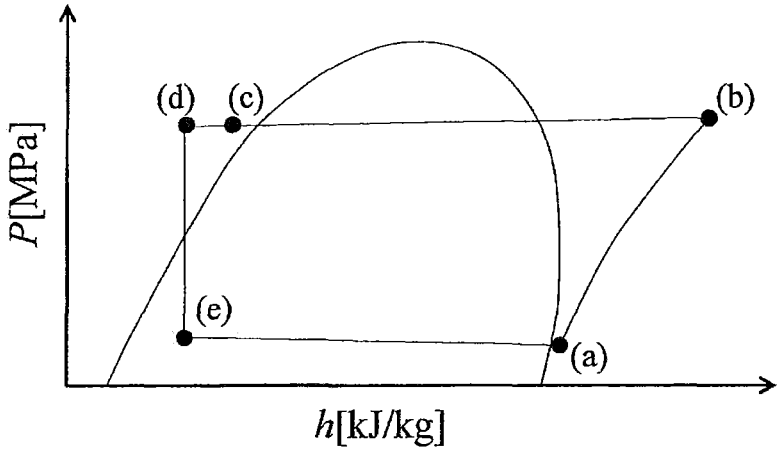
FIG. 3 is a P-h diagram illustrating the transition of refrigerant in the case where the air-conditioning apparatus according to Embodiment 1 of the present invention does not perform injection during a cooling operation.

The case where all the indoor units C to E are about to perform cooling will be explained hereinafter. In the case where cooling is performed, the four-way switching valve 2 is switched so that the refrigerant discharged from the compressor 1 flows into the outdoor heat exchanger 3. Furthermore, the solenoid valves 8*c*, 8*d*, and 8*e* connected to the indoor units C, D, and E, respectively, are opened, and the solenoid valves 8*f*, 8*g*, and 8*h* are closed. FIG. 3 is a P-h diagram illustrating the transition of refrigerant during the cooling operation.

In this state, the compressor 1 starts operation. A low-temperature and low-pressure gas refrigerant is compressed by the compressor 1 and is discharged as a high-temperature and high-pressure gas refrigerant. In the refrigerant compression process by the compressor 1, compression is performed in such a manner that the refrigerant is heated more than when the refrigerant is adiabatically compressed based on an isentropic line by the adiabatic efficiency of the compressor, and is represented by a line extending from point (a) to point (b) in FIG. 3.

The high-temperature and high-pressure gas refrigerant discharged from the compressor 1 flows into the outdoor heat exchanger 3 via the four-way switching valve 2. At this time, the refrigerant is cooled while heating the outdoor air, and turns into an intermediate-temperature and high-pressure liquid refrigerant. The change of the refrigerant in the outdoor heat exchanger 3 is represented by a slightly-slanted substantially horizontal straight line extending from point (b) to point (c) in FIG. 3, in view of pressure loss in the heat-source-side heat exchanger 3.

The intermediate-temperature and high-pressure liquid refrigerant that has flowed out of the outdoor heat exchanger 3 is split at the second refrigerant pipe 7 and the gas-liquid separator 12. After performing heat exchange in the first heat exchanger 17 with the refrigerant flowing in the second bypass pipe 14*b*, the refrigerant passes through the second flow rate control device 13, performs heat exchange in the second heat exchanger 16 with the refrigerant flowing in the second bypass pipe 14*b*, and is cooled. The cooling process at this time is represented by a line extending from point (c) to point (d) in FIG. 3.

The liquid refrigerant cooled at the first and second heat exchangers 17 and 16 flows into the second branch portion 11, part of the refrigerant is bypassed through the second bypass pipe 14*b*, and the remaining refrigerant flows into the second refrigerant pipes 7*c*, 7*d*, and 7*e* on the indoor unit side. The high-pressure liquid refrigerants split at the second branch portion 11 flow through the second refrigerant pipes 7*c*, 7*d*, and 7*e* on the indoor unit side, and flow into the first flow rate control devices 9*c*, 9*d*, and 9*e* of the indoor units C, D, and E, respectively. Then, the high-pressure liquid refrigerants are expanded by the first flow rate control devices 9*c*, 9*d*, and 9*e* and decompressed into a low-temperature and low-pressure, two-phase gas-liquid state. The change of the refrigerants at the first flow rate control devices 9*c*, 9*d*, and 9*e* occurs with a constant enthalpy. The change of the refrigerants at this time is represented by a vertical line extending from point (d) to point (e) in FIG. 3.

The low-temperature and low-pressure refrigerants in the two-phase gas-liquid state that have flowed out of the first flow rate control devices 9*c*, 9*d*, and 9*e* flow into the indoor heat exchangers 5*c*, 5*d*, and 5*e*. Then, the refrigerants are heated while cooling the indoor air, and turn into low-temperature and low-pressure gas refrigerants. The change of the refrigerants at the indoor heat exchangers 5*c*, 5*d*, and 5*e* is represented by a slightly-slanted substantially horizontal straight line extending from point (e) to point (a) in FIG. 3, in view of pressure loss.

The low-temperature and low-pressure gas refrigerants that have flowed out of the indoor heat exchangers 5*c*, 5*d*, and 5*e* pass through the solenoid valves 8*c*, 8*d*, and 8*e*, respectively, and flow into the first branch portion 10. The low-temperature and low-pressure gas refrigerants merged together at the first branch portion 10 are merged with a low-temperature and low-pressure gas refrigerant heated by the first and second heat exchangers 17 and 16 at the second bypass pipe 14*b*. The merged refrigerant flows into the compressor 1 via the first refrigerant pipe 6 and the four-way switching valve 2, and is compressed.

In the case where the outside air temperature is low and the discharge pressure of the refrigerant discharged from the compressor 1 has decreased, in order to increase the pressure difference between the input and output of the compressor 1, the flow rate of refrigerant to flow into the outdoor heat exchanger 3 can be changed by operating the sixth flow rate control device 26 which allows bypassing of the outdoor heat exchanger 3, so that the amount of heat exchange of the outdoor heat exchanger 3 is controlled.

[Cooling Operation: Case where Injection is Performed]

Figure 4:
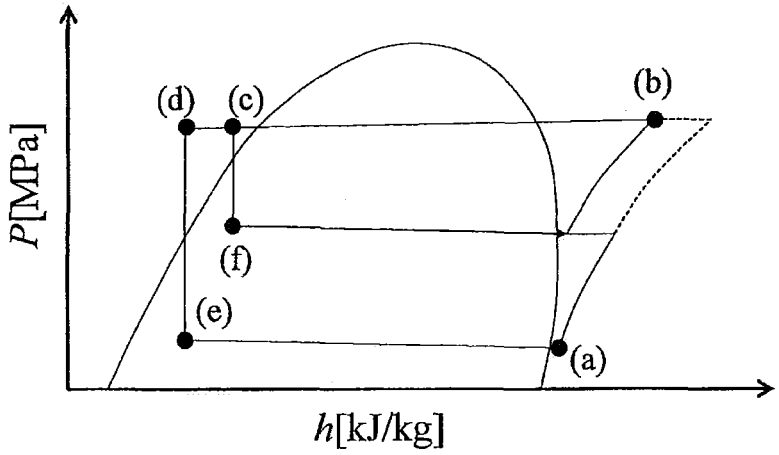
FIG. 4 is a P-h diagram illustrating the transition of refrigerant in the case where the air-conditioning apparatus according to Embodiment 1 of the present invention performs injection during a cooling operation.

In the case where the outside air temperature is high or the indoor temperature is low, the compression ratio of refrigerant is high, and the discharge temperature is therefore high unless injection is performed. The operation of the air-conditioning apparatus 100 in such a case will be explained. FIG. 4 is a P-h diagram illustrating the transition of refrigerant during the cooling operation. Since the flow of refrigerant in the main flow part is similar to the above-described case where injection is not performed during the cooling operation, an explanation for the flow of the refrigerant in the main flow part will be omitted.

In the case where injection into the compressor 1 is performed, the fifth flow rate control device 24 at the injection pipe 23 is controlled to be opened. Accordingly, a liquid refrigerant cooled at the outdoor heat exchanger 3 partially branches off into the injection pipe 23 and is decompressed by the fifth flow rate control device 24. The change of the refrigerant at this time is represented by a line extending from point (c) to point (f) in FIG. 4. The refrigerant decompressed by the fifth flow rate control device 24 passes through the injection pipe 23, and is injected into the refrigerant being compressed by the compressor 1. This lowers the discharge temperature of the refrigerant discharged from the compressor 1.

[Heating Operation: Case where Injection is not Performed]

Figure 5:
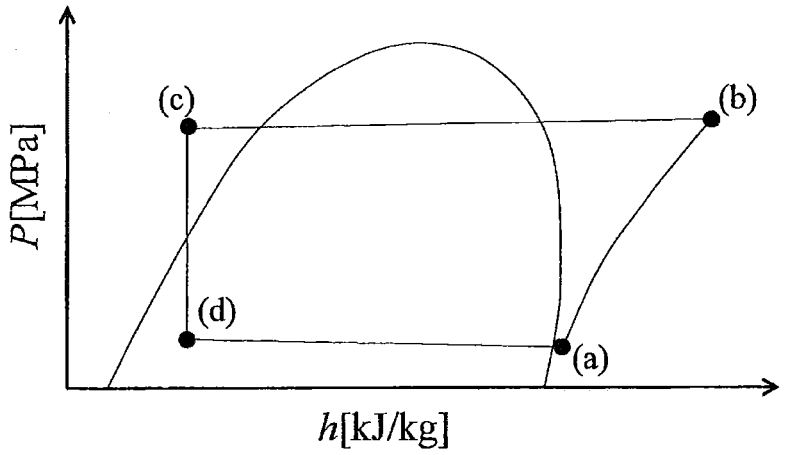
FIG. 5 is a P-h diagram illustrating the transition of refrigerant in the case where the air-conditioning apparatus according to Embodiment 1 of the present invention does not perform injection during a heating operation.

The case where all the indoor units C, D, and E are about to perform heating will be explained hereinafter. In the case where a heating operation is performed, the four-way switching valve 2 is switched so that the refrigerant discharged from the compressor 1 flows into the first branch portion 10. Furthermore, the solenoid valves 8*c*, 8*d*, and 8*e* connected to the indoor units C, D, and E, respectively, are closed, and the solenoid valves 8*f*, 8*g*, and 8*h* are opened. FIG. 5 is a P-h diagram illustrating the transition of refrigerant during the heating operation.

In this state, the compressor 1 starts operation. A low-temperature and low-pressure gas refrigerant is compressed by the compressor 1 and is discharged as a high-temperature and high-pressure gas refrigerant. The refrigerant compression process by the compressor is represented by a line extending from point (a) to point (b) in FIG. 5.

The high-temperature and high-pressure gas refrigerant discharged from the compressor 1 flows into the first branch portion 10 via the four-way switching valve 2 and the second refrigerant pipe 7. The high-temperature and high-pressure gas refrigerant that has flowed into the first branch portion 10 is split at the first branch portion 10. The split refrigerants pass through the solenoid valves 8*f*, 8*g*, and 8*h*, and flow into the indoor heat exchangers 5*c*, 5*d*, and 5*e*. Then, the refrigerants are heated while cooling the indoor air, and turn into intermediate-temperature and high-pressure liquid refrigerants. The change of the refrigerants at the indoor heat exchangers 5*c*, 5*d*, and 5*e* is represented by a slightly-slanted substantially horizontal straight line extending from point (b) to point (c) in FIG. 5.

The intermediate-temperature and high-pressure liquid refrigerants that have flowed out of the indoor heat exchangers 5*c*, 5*d*, and 5*e* flow into the first flow rate control devices 9*c*, 9*d*, and 9*e*, respectively, and are merged together at the second branch portion 11. The merged refrigerant flows into the third flow rate control device 15. The high-pressure liquid refrigerant is expanded and decompressed by the first flow rate control devices 9*c*, 9*d*, and 9*e*, the third flow rate control device 15, and the fourth flow rate control device 22, and turns into a low-temperature and low-pressure, two-phase gas-liquid state. The change of the refrigerant at this time is represented by a vertical line extending from point (c) to point (d) in FIG. 5.

The low-temperature and low-pressure refrigerant in the two-phase gas-liquid state that has flowed out of the fourth flow rate control device 22 flows into the outdoor heat exchanger 3, is heated while cooling the outdoor air, and turns into a low-temperature and low-pressure gas refrigerant. The change of the refrigerant at the outdoor heat exchanger 3 is represented by a slightly-slanted substantially horizontal straight line extending from point (d) to point (a) in FIG. 5. The low-temperature and low-pressure gas refrigerant that has flowed out of the outdoor heat exchanger 3 passes through the four-way switching valve 2, flows into the compressor 1, and is compressed.

In the case where the outside air temperature is high and the suction pressure has increased, in order to increase the pressure difference between the input and output of the compressor 1, the flow rate of refrigerant to flow into the outdoor heat exchanger 3 can be changed by operating the sixth flow rate control device 26 which allows bypassing of the outdoor heat exchanger 3, so that the amount of heat exchange of the outdoor heat exchanger 3 is controlled.

[Heating Operation: Case where Injection is Performed]

Figure 6:
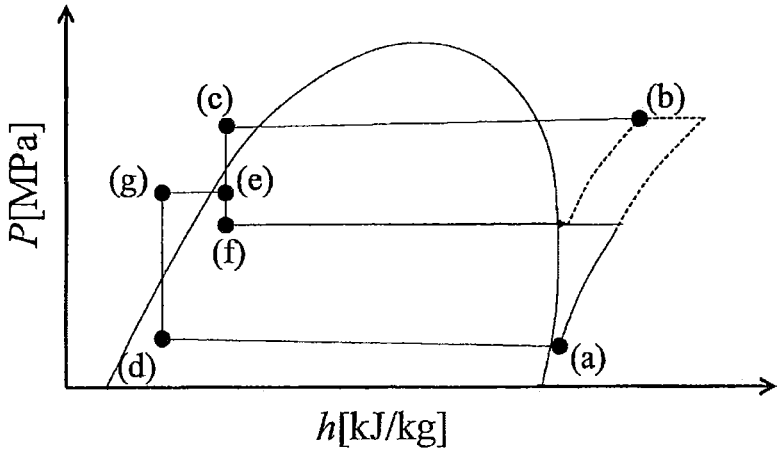
FIG. 6 is a P-h diagram illustrating the transition of refrigerant in the case where the air-conditioning apparatus according to Embodiment 1 of the present invention performs injection during a heating operation.

The operation of the air-conditioning apparatus 100 in the case where the outside air temperature is low and a given heating capacity is required or in the case where the compression ratio between the input and output of the compressor 1 increases and the discharge temperature is therefore high unless injection is performed, will be explained below. FIG. 6 is a P-h diagram illustrating the transition of refrigerant during the heating operation. Since the flow of refrigerant in the main flow part is basically similar to the above-described case where injection is not performed during the heating operation, an explanation for the flow of the refrigerant in the main flow part will be omitted.

Furthermore, in the case where injection is not performed, the balance between throttling by the third flow rate control device 15 and throttling by the fourth flow rate control device 22 is set arbitrarily. However, in the case where injection is performed, in order to increase the pressure of refrigerant to be injected into the compressor 1 so that the flow rate can be easily adjusted, it is preferable to set the pressure difference between the discharge pressure and the outlet of the third flow rate control device 15 (intermediate pressure) to about 1 MPa, and adjust the flow rate of refrigerant to flow into the outdoor heat exchanger 3 at the fourth flow rate control device 22.

Part of refrigerant that has circulated through the indoor units C, D, and E and has returned to the outdoor unit A (point (e) of FIG. 6) flows into the fourth flow rate control device 22, and the remaining refrigerant flows into the fifth flow rate control device 24. The main-flow refrigerant that has flowed into the fourth flow rate control device 22 is decompressed at the fourth flow rate control device 22 (point (d)), and flows into the outdoor heat exchanger 3. In contrast, the split refrigerant that has flowed into the injection pipe 23 is decompressed at the fifth flow rate control device 24 (point (f)), and is injected into the compressor 1. The flow rate of refrigerant is increased by a refrigerant in a two-phase gas-liquid state being injected into the compressor 1. Thus, the discharge temperature is lowered, and the heating capacity is increased.

[Cooling Main Operation: Case where Injection is not Performed]

Figure 7:
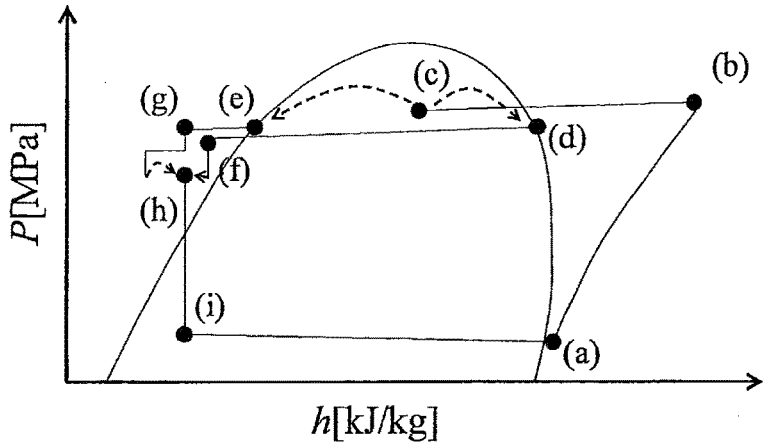
FIG. 7 is a P-h diagram illustrating the transition of refrigerant in the case where the air-conditioning apparatus according to Embodiment 1 of the present invention does not perform injection during a cooling main operation.

The case where the indoor units C and D are performing cooling and the indoor unit E is performing heating will be explained hereinafter. In this case, the four-way switching valve 2 is switched so that the refrigerant discharged from the compressor 1 flows into the outdoor heat exchanger 3. Furthermore, the solenoid valves 8*c*, 8*d*, and 8*h* connected to the indoor units C, D, and E, respectively, are opened, and the solenoid valves 8*f*, 8*g*, and 8*e* are closed. FIG. 7 is a P-h diagram illustrating the transition of refrigerant during the cooling main operation.

In this state, the compressor 1 starts operation. A low-temperature and low-pressure gas refrigerant is compressed by the compressor 1, and is discharged as a high-temperature and high-pressure gas refrigerant. The refrigerant compression process by the compressor 1 is represented by a line extending from point (a) to point (b) in FIG. 7.

The high-temperature and high-pressure gas refrigerant discharged from the compressor 1 flows into the outdoor heat exchanger 3 via the four-way switching valve 2. At this time, in the outdoor heat exchanger 3, the refrigerant is cooled while heating the outdoor air with a heat quantity necessary for heating being left, and turns into an intermediate-temperature and high-pressure, two-phase gas-liquid state. The change of the refrigerant at the outdoor heat exchanger 3 is represented by a slightly-slanted substantially horizontal straight line extending from point (b) to point (c) in FIG. 7.

The intermediate-temperature and high-pressure, two-phase gas-liquid refrigerant that has flowed out of the outdoor heat exchanger 3 passes through the second refrigerant pipe 7, and flows into the gas-liquid separator 12. Then, at the gas-liquid separator 12, the refrigerant is separated into a gas refrigerant (point (d)) and a liquid refrigerant (point (e)).

The gas refrigerant (point (d)) separated at the gas-liquid separator 12 flows into the indoor heat exchanger 5*e* performing heating, via the first branch portion 10 and the solenoid valve 8*h*. Then, the refrigerant is cooled while heating the indoor air, and turns into an intermediate-temperature and high-pressure liquid refrigerant. The change of the refrigerant at the indoor heat exchanger 5*e* is represented by a slightly-slanted substantially horizontal straight line extending from point (d) to point (f) in FIG. 7.

In contrast, the liquid refrigerant (point (e)) separated at the gas-liquid separator 12 flows into the first heat exchanger 17, exchanges heat with a low-pressure refrigerant flowing through the second bypass pipe 14*b*, and is cooled. The change of the refrigerant at the first heat exchanger 17 is represented by a slightly-slanted substantially horizontal straight line extending from point (e) to point (g) in FIG. 7.

The refrigerant that has flowed out of the indoor heat exchanger 5*e* performing heating (point (f)) and that has passed through the first flow rate control device 9*e* and the refrigerant that has flowed out of the first heat exchanger 17 (point (g)) and that has passed through the second flow rate control device 13 and the second heat exchanger 16 are merged together in the second branch portion 11 (point (h)). Part of the merged liquid refrigerant is bypassed through the second bypass pipe 14*b*, and the remaining refrigerant flows into the first flow rate control devices 9*c* and 9*d* of the indoor units C and D, respectively, performing cooling. Then, the high-pressure liquid refrigerants are throttled by the first flow rate control devices 9*c* and 9*d*, are decompressed, and turn into low-temperature and low-pressure, two-phase gas-liquid state. The change of the refrigerants at the first flow rate control devices 9*c* and 9*d* occurs with a constant enthalpy. The change of the refrigerants at this time is represented by a vertical line extending from point (h) to point (i) in FIG. 7.

The low-temperature and low-pressure refrigerants in the two-phase gas-liquid state that have flowed out of the first flow rate control devices 9*c* and 9*d* flow into the indoor heat exchangers 5*c* and 5*d*, respectively, performing cooling. Then, the refrigerants are heated while cooling the indoor air, and turn into low-temperature and low-pressure gas refrigerants. The change of the refrigerants at the indoor heat exchangers 5*c* and 5*d* is represented by a slightly-slanted substantially horizontal straight line extending from point (i) to point (a) in FIG. 7.

The low-temperature and low-pressure gas refrigerants that have flowed out of the indoor heat exchangers 5*c* and 5*d* pass through the solenoid valves 8*c* and 8*d*, respectively, and flow into the first branch portion 10. The low-temperature and low-pressure gas refrigerants merged together at the first branch portion 10 are merged with the low-temperature and low-pressure gas refrigerant heated by the first and second heat exchangers 17 and 16 at the second bypass pipe 14*b*. The merged refrigerant passes through the first refrigerant pipe 6 and the four-way switching valve 2, flows into the compressor 1, and is compressed.

In the case where the outside air temperature is low, the discharge pressure has decreased, and the heating capacity is insufficient, in order to increase the pressure difference between the input and output of the compressor 1, the flow rate of refrigerant to flow into the outdoor heat exchanger 3 can be changed by operating the sixth flow rate control device 26 which allows bypassing of the outdoor heat exchanger 3, so that the amount of heat exchange of the outdoor heat exchanger 3 is controlled.

[Cooling Main Operation: Case where Injection is Performed]

Figure 8:
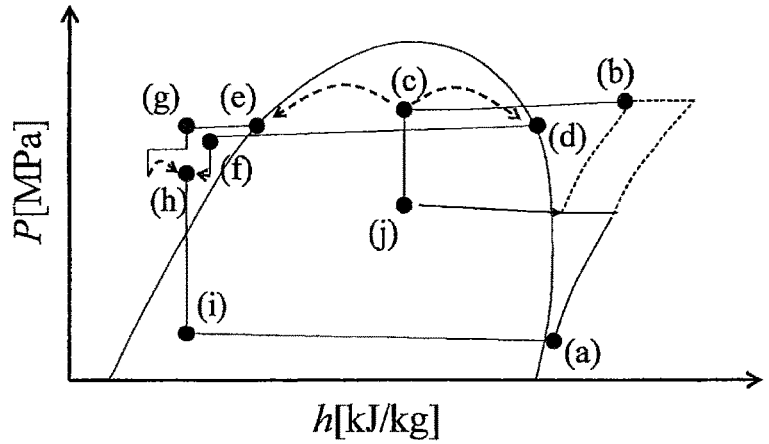
FIG. 8 is a P-h diagram illustrating the transition of refrigerant in the case where the air-conditioning apparatus according to Embodiment 1 of the present invention performs injection during a cooling main operation.

The operation of the air-conditioning apparatus 100 in the case where the compression ratio of refrigerant increases and the discharge temperature is therefore high unless injection is performed will be explained. FIG. 8 is a P-h diagram illustrating the transition of refrigerant during the cooling main operation. Since the flow of refrigerant in the main flow part is basically similar to the case where injection is not performed, an explanation for the flow of the refrigerant in the main flow part will be omitted.

In the case where injection into the compressor 1 is performed, the fifth flow rate control device 24 at the injection pipe 23 is controlled to be opened. Accordingly, part of the refrigerant cooled by the outdoor heat exchanger 3 is split and flows into the injection pipe 23, and is decompressed by the fifth flow rate control device 24 (point (j) in FIG. 8). The two-phase gas-liquid refrigerant decompressed by the fifth flow rate control device 24 passes through the injection pipe 23, and is injected into the refrigerant being compressed by the compressor 1. This lowers the discharge temperature of the refrigerant discharged from the compressor 1.

[Heating Main Operation: Case where Injection is not Performed]

Figure 9:
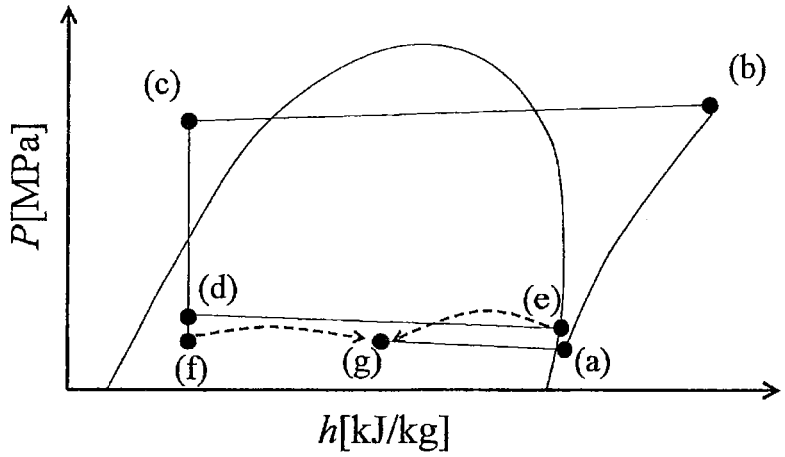
FIG. 9 is a P-h diagram illustrating the transition of refrigerant in the case where the air-conditioning apparatus according to Embodiment 1 of the present invention does not perform injection during a heating main operation.

The case where the indoor unit C is performing cooling and the indoor units D and E are performing heating will be explained hereinafter. In this case, the four-way switching valve 2 is switched so that the refrigerant discharged from the compressor 1 flows into the first branch portion 10. Furthermore, the solenoid valves 8*f*, 8*d*, and 8*e* connected to the indoor units C, D, and E, respectively, are closed, and the solenoid valves 8*c*, 8*g*, and 8*h* are opened. In addition, in order to reduce the pressure difference between the indoor unit C performing cooling and the outdoor heat exchanger 3, the flow rate control device 22 is controlled to be fully opened or controlled such that the evaporating pressure of the second refrigerant pipe 7 becomes about 0 degrees Centigrade in terms of saturation temperature. FIG. 9 is a P-h diagram illustrating the transition of refrigerant during the heating main operation.

In this state, the compressor 1 starts operation. A low-temperature and low-pressure gas refrigerant is compressed by the compressor 1, and is discharged as a high-temperature and high-pressure gas refrigerant. The refrigerant compression process by the compressor is represented by a line extending from point (a) to point (b) in FIG. 9.

The high-temperature and high-pressure gas refrigerant discharged from the compressor 1 flows into the first branch portion 10 via the four-way switching valve 2 and the second refrigerant pipe 7. The high-temperature and high-pressure gas refrigerant that has flowed into the first branch portion 10 is split at the first branch portion 10, and the split refrigerants pass through the solenoid valves 8*g* and 8*h* and flow into the indoor heat exchangers 5*d* and 5*e* of the indoor units D and E performing heating. Then, the refrigerants are cooled while heating the indoor air, and turn into intermediate-temperature and high-pressure liquid refrigerants. The change of the refrigerants at the indoor heat exchangers 5*d* and 5*e* is represented by a slightly-slanted substantially horizontal straight line extending from point (b) to point (c) in FIG. 9.

The intermediate-temperature and high-pressure liquid refrigerants that have flowed out of the indoor heat exchangers 5*d* and 5*e* flow into the first flow rate control devices 9*d* and 9*e*, and are merged together at the second branch portion 11. Part of the high-pressure liquid refrigerant merged at the second branch portion 11 flows into the first flow rate control device 9*c* connected to the indoor unit C performing cooling. Then, the high-pressure liquid refrigerant is throttled by the first flow rate control device 9*c*, is decompressed, and turns into a low-temperature and low-pressure, two-phase gas-liquid state. The change of the refrigerant at this time is represented by a vertical line extending from point (c) to point (d) in FIG. 9.

The low-temperature and low-pressure refrigerant in the two-phase gas-liquid state that has flowed out of the first flow rate control device 9*c* flows into the indoor heat exchanger 5*c* performing cooling. Then, the refrigerant is heated while cooling the indoor air, and turns into a low-temperature and low-pressure gas refrigerant. The change of the refrigerant at this time is represented by a slightly-slanted substantially horizontal straight line extending from point (d) to point (e) in FIG. 9. The low-temperature and low-pressure gas refrigerant that has flowed out of the indoor heat exchanger 5*c* passes through the solenoid valve 8*c*, and flows into the first refrigerant pipe 6.

In contrast, the remaining high-pressure liquid refrigerant that has flowed into the second branch portion 11 from the indoor heat exchangers 5*d* and 5*e* performing heating flows into the third flow rate control device 15. Then, the high-pressure liquid refrigerant is expanded (decompressed) upon being throttled by the third flow rate control device 15, and turns into a low-temperature and low-pressure, two-phase gas-liquid state. The change of the refrigerant at this time is represented by a vertical line extending from point (c) to point (f) in FIG. 9. The low-temperature and low-pressure refrigerant in the two-phase gas-liquid state that has flowed out of the third flow rate control device 15 flows into the first refrigerant pipe 6, and is merged with a low-temperature and low-pressure vapor refrigerant that has flowed in it from the indoor heat exchanger 5*c* performing cooling (point (g) in FIG. 9).

The low-temperature and low-pressure refrigerant in the two-phase gas-liquid state that has been merged at the first refrigerant pipe 6 flows into the outdoor heat exchanger 3. Then, the refrigerant receives heat from the outdoor air, and turns into a low-temperature and low-pressure gas refrigerant. The change of the refrigerant at this time is represented by a slightly-slanted substantially horizontal straight line extending from point (g) to point (a) in FIG. 9. The low-temperature and low-pressure gas refrigerant that has flowed out of the outdoor heat exchanger 3 passes through the four-way switching valve 2, flows into the compressor 1, and is compressed.

[Heating Main Operation: Case where Injection is Performed]

Figure 10:
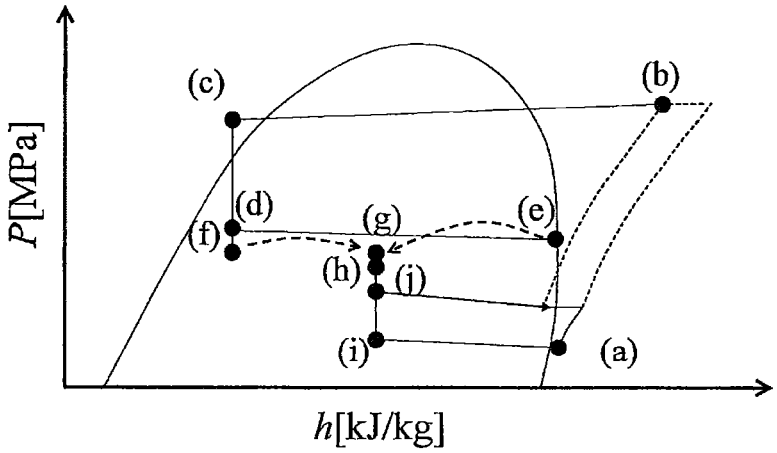
FIG. 10 is a P-h diagram illustrating the transition of refrigerant in the case where the air-conditioning apparatus according to Embodiment 1 of the present invention performs injection during a heating main operation.

The operation of the air-conditioning apparatus 100 in the case where the compression ratio of refrigerant increases and the discharge temperature is therefore high unless injection is performed will be explained below. FIG. 10 is a P-h diagram illustrating the transition of refrigerant during the heating main operation. Since the flow of refrigerant in the main flow part is similar to the case where injection is not performed, an explanation for the flow of the refrigerant in the main flow part will be omitted.

In order to increase the pressure of refrigerant to be injected into the compressor 1 and to ensure the capacity of an indoor unit performing cooling, the throttling of the fourth flow rate control device 22 is controlled such that the evaporating temperature of the first refrigerant pipe 6 becomes about 0 degrees Centigrade. Here, part of a two-phase gas-liquid refrigerant that has circulated through the indoor unit and has flowed into the outdoor unit (point (h) in FIG. 10) flows into the fourth flow rate control device 22, and the remaining refrigerant flows into the fifth flow rate control device 24. The main-flow refrigerant that has flowed into the fourth flow rate control device 22 is decompressed (point (i) in FIG. 10), and flows into the outdoor heat exchanger 3. In contrast, the split refrigerant is decompressed by the fifth flow rate control device 24 (point (j)), and is injected into the compressor 1. The flow rate of refrigerant is increased by the two-phase gas-liquid refrigerant being injected into the compressor. Thus, the discharge temperature is lowered, and the heating capacity is increased.

[Case where Defrosting Operation is Performed]

The case where frost is formed on the outdoor heat exchanger 3 and a defrosting operation is performed will be discussed hereinafter. In order to perform defrosting efficiently, it is required to decrease the temperature difference between the outside air temperature and the temperature of refrigerant, to prevent heat transfer, and to shorten the defrosting time to shorten the time during which heat is transferred to the outside air. In particular, R32 or a refrigerant mixture of R32 and HFO1234yf or HFO1234ze has a discharge temperature higher than that of an R410A refrigerant. Therefore, it is effective to lower the discharge temperature by injection and to increase the flow rate of refrigerant, thereby improving the defrosting capacity.

[Another Circuit Configuration of Air-Conditioning Apparatus 100]

As described above, the air-conditioning apparatus 100 is capable of heat exchange amount control of the outdoor heat exchanger 3 and injection control while suppressing the influence of pressure loss generated by the flow rate control devices (the fourth flow rate control device 22 and the sixth flow rate control device 26), regardless of the operation mode, and by lowering the discharge temperature of the compressor 1, the compressor 1 is able to operate with high reliability.

Figure 11:
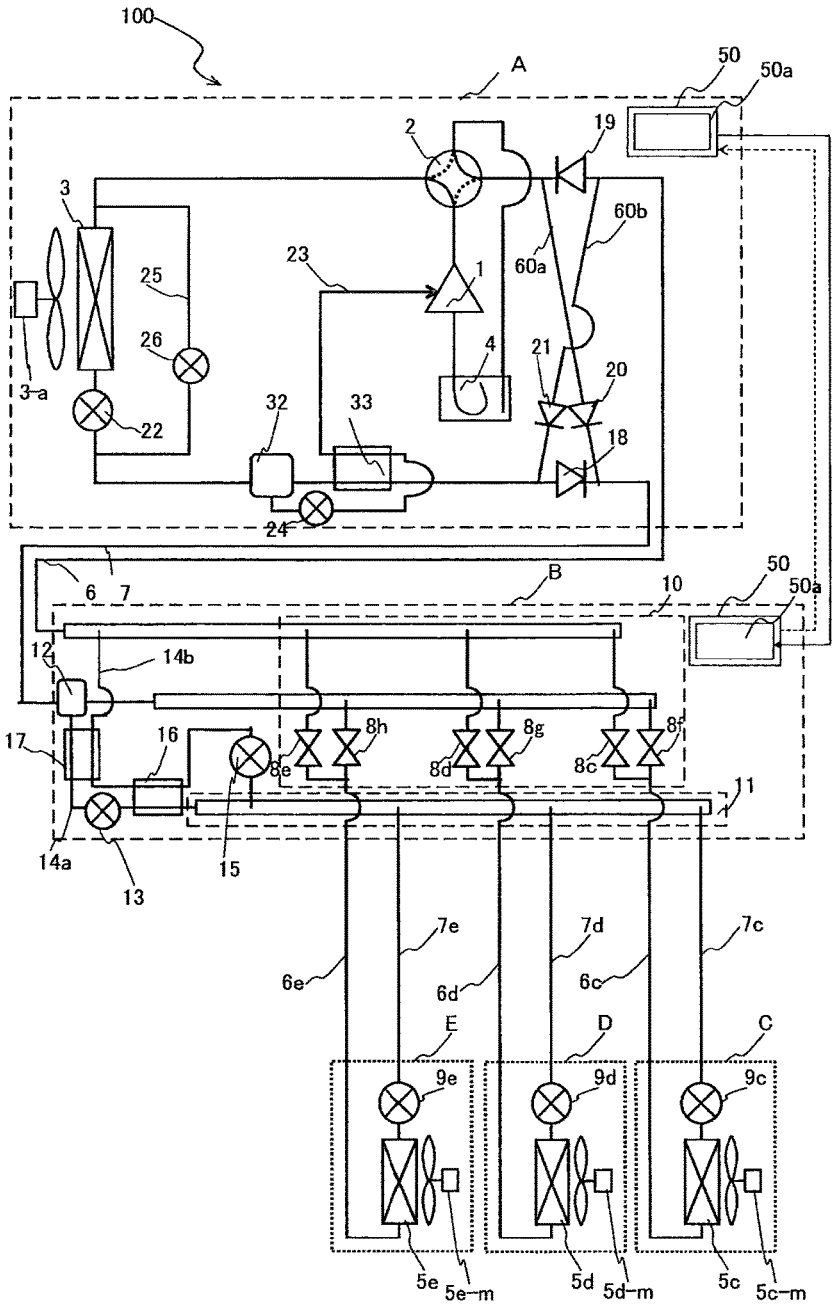
FIG. 11 is a refrigerant circuit diagram illustrating another example of the refrigerant circuit configuration of the air-conditioning apparatus according to Embodiment 1 of the present invention.

Furthermore, in the air-conditioning apparatus 100, when injection is performed at the time of a cooling main operation or a heating main operation, a two-phase gas-liquid refrigerant containing a large amount of gas component is often injected, depending on the load conditions. It is preferable to inject a refrigerant containing a large amount of liquid in order to reliably decrease the discharge temperature. Therefore, the air-conditioning apparatus 100 may have a circuit configuration including a gas-liquid separator 32 and a third heat exchanger 33, as illustrated in FIG. 11. FIG. 11 is a refrigerant circuit diagram illustrating another example of the refrigerant circuit configuration of the air-conditioning apparatus 100.

The gas-liquid separator 32 is provided between the check valves 18 and 21, the fourth flow rate control device 22 and the fifth flow rate control device 24, and the fifth flow rate control device 26, that is, at the connecting position of the injection pipe 23. The gas-liquid separator 32 is configured to split a refrigerant in an intermediate-pressure state into a main-flow refrigerant and a refrigerant to be injected. Then, the injection pipe 23 need only be connected to a liquid-phase component generated by the gas-liquid separator 32. The third heat exchanger 33 is installed at the position where heat exchange between the main-flow refrigerant flowing between the check valves 18 and 21, and the gas-liquid separator 32, and the refrigerant flowing through the injection pipe 23 can be performed.

By installing the gas-liquid separator 32 and the third heat exchanger 33, in the air-conditioning apparatus 100, the capacity of an evaporator is further increased, and the cooling and heating performance is further improved.

[Control of Actuator Such as Compressor 1]

Control of actuators including the compressor 1, which serve as components of the air-conditioning apparatus 100, will be considered lastly. As described above, the air-conditioning apparatus 100 includes the pressure gauge 51 which measures the discharge pressure of refrigerant, the pressure gauge 52 which measures the suction pressure, the pressure gauge 53 which measures the intermediate pressure, and the thermometer 54 which measures the discharge temperature of refrigerant. Instead of the pressure gauge 53, a thermometer may be installed so that the intermediate pressure is estimated by pressure conversion from a measured saturation temperature.

The driving frequency of the compressor 1 and the rotation speed of the outdoor fan 3-*a* provided in the outdoor heat exchanger 3 are controlled such that the cooling and heating capacities of each indoor unit reach predetermined capacities by referring to measurement values obtained by the pressure gauges 51 and 52. At this time, it may be estimated on the basis of the pressures at the input and output of the compressor 1 whether an indoor unit exhibits a predetermined capacity. This is because since an indoor unit is generally designed to exhibit a required capacity at a predetermined condensing temperature and evaporating temperature (for example, a condensing temperature of 40 degrees Centigrade for heating and an evaporating temperature of 10 degrees Centigrade for cooling), the cooling and heating capacities of the indoor unit can be adjusted by controlling the discharge pressure and suction pressure of the compressor 1.

As described above, the air-conditioning apparatus 100 includes the controller 50 including the memory 50*a* within each of the outdoor unit A and the relay unit B. The controllers 50 are connected to each other wirelessly or via wire so that they can communicate with each other. In the configuration of the present invention, the controller 50 is installed within each of the outdoor unit A and the relay unit B. However, no problem is posed even when controlling means is integrated into one unit and actuators are controlled by making individual units communicate control values. In the following description, the two controllers 50 will sometimes be collectively referred to as a controller 50.

The controller 50 performs driving control, such as operation, stopping, and the like of fan motors for the indoor fans 5*c-m* to 5*e-m* on the basis of the settings of remote control for the indoor units C to E and the current indoor temperature. Furthermore, the controller 50 sets the opening degrees of flow rate control devices and switches solenoid valves in the relay unit B, in accordance with the operation mode based on the operation capacity for cooling and heating of each of the indoor units C to E. Moreover, the controller 50 drives the compressor 1, switches the four-way switching valve 2, and performs driving control of the fan motor for the outdoor fan 3-*a*.

Figure 12:
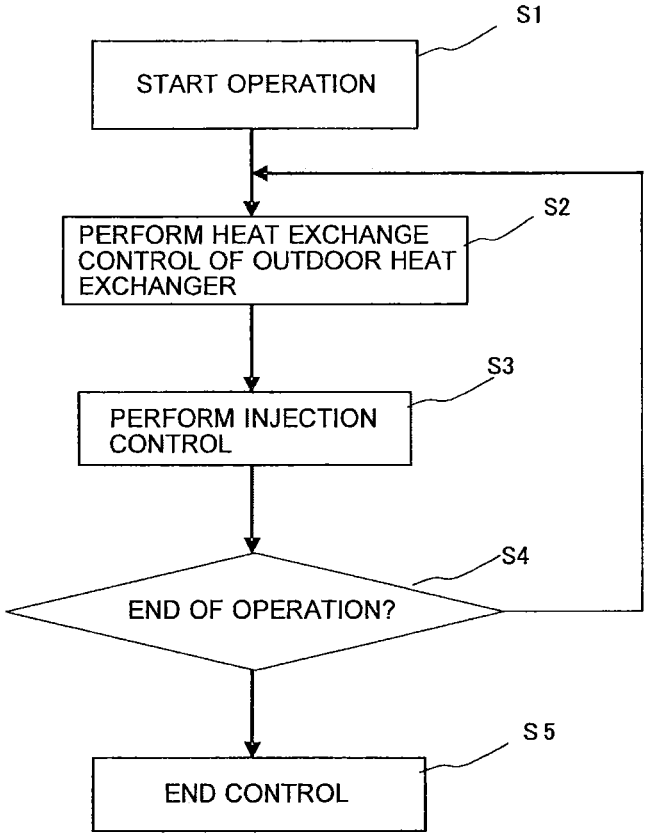
FIG. 12 is a flowchart illustrating the control flow of heat exchange amount control of an outdoor heat exchanger and injection control performed by the air-conditioning apparatus according to Embodiment 1 of the present invention.
Figure 13:
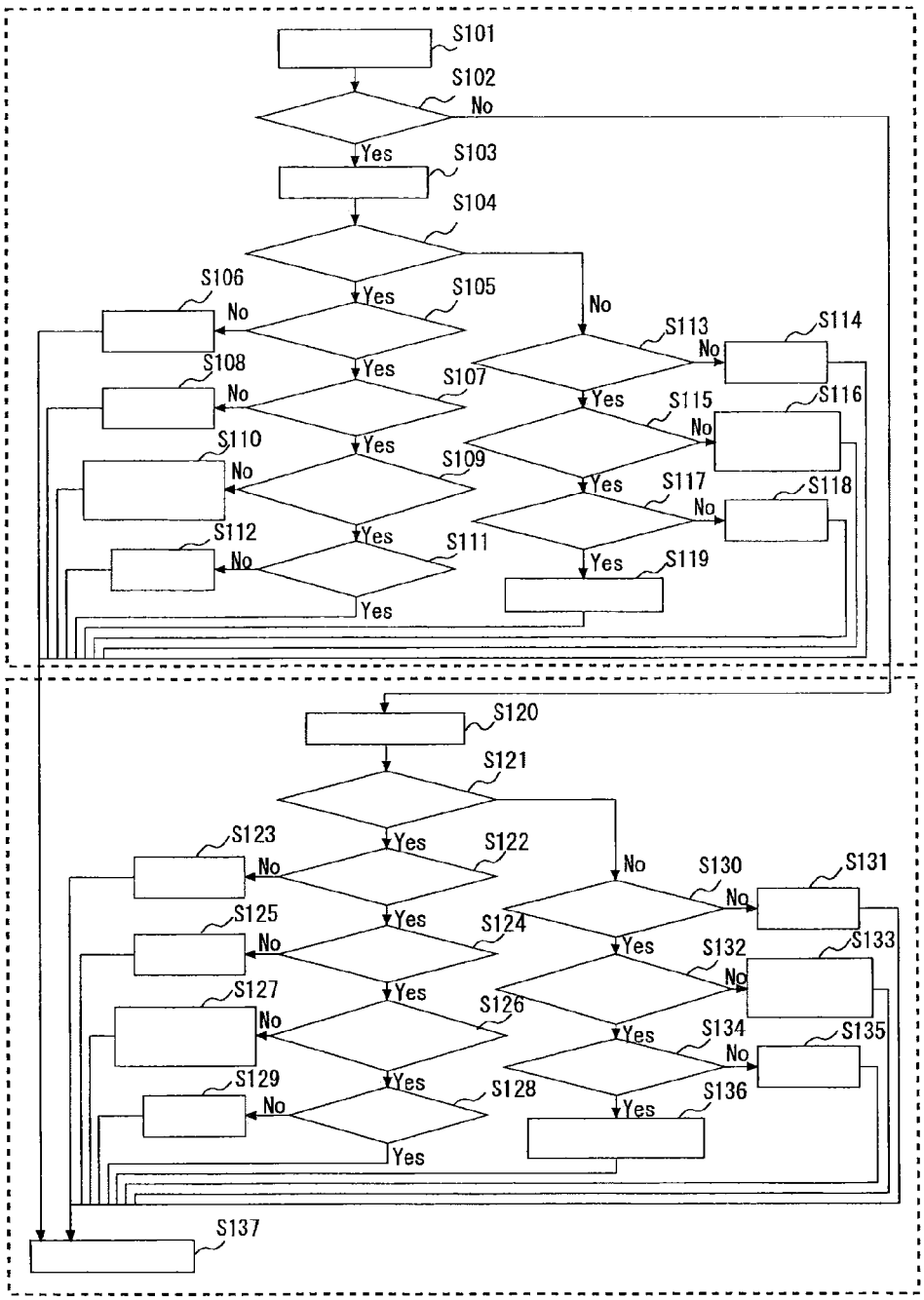
FIG. 13 is a flowchart illustrating the detailed control flow of the heat exchange amount control of the outdoor heat exchanger performed by the air-conditioning apparatus according to Embodiment 1 of the present invention.
Figure 13A:
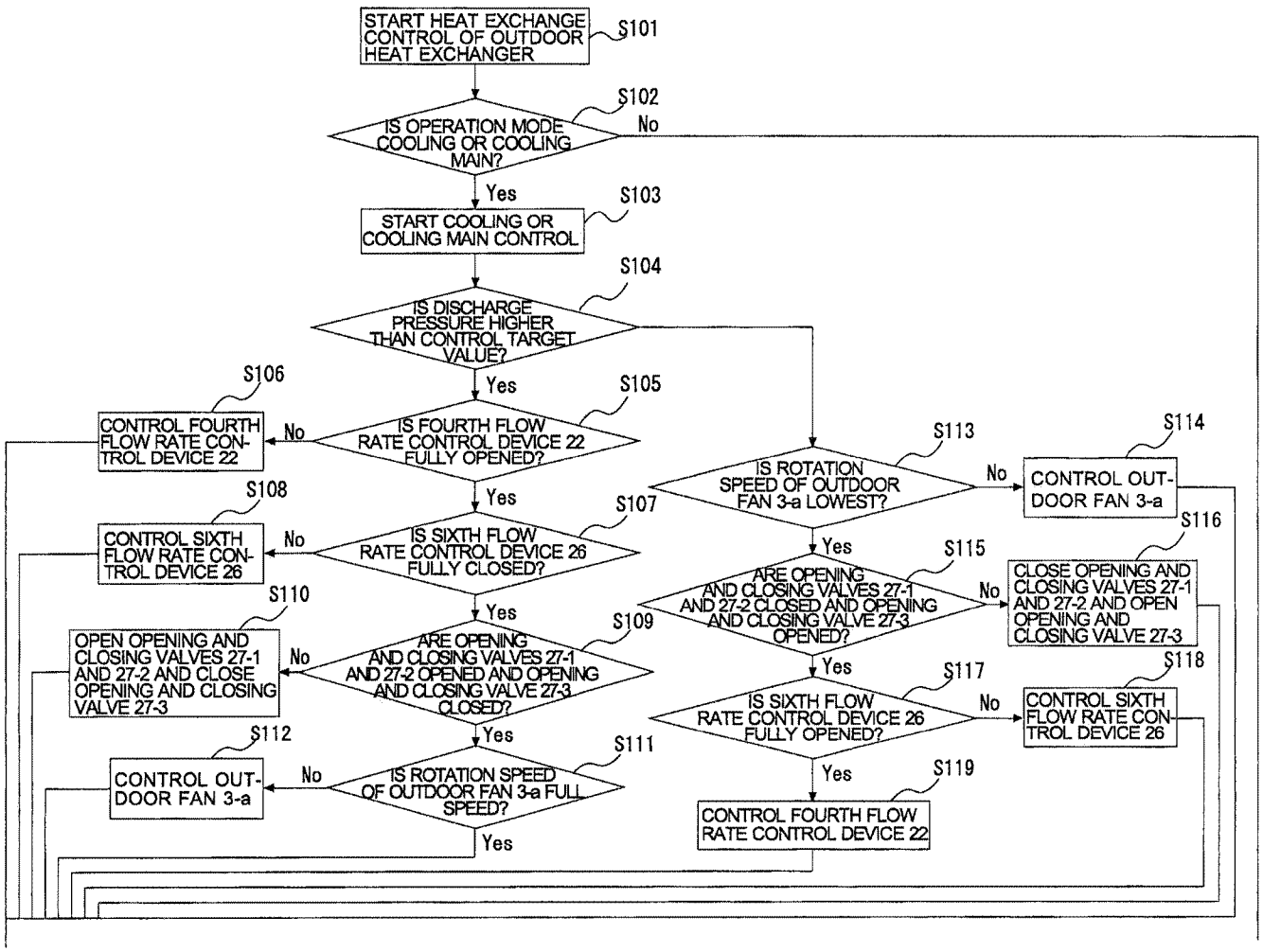
Figure 13B:
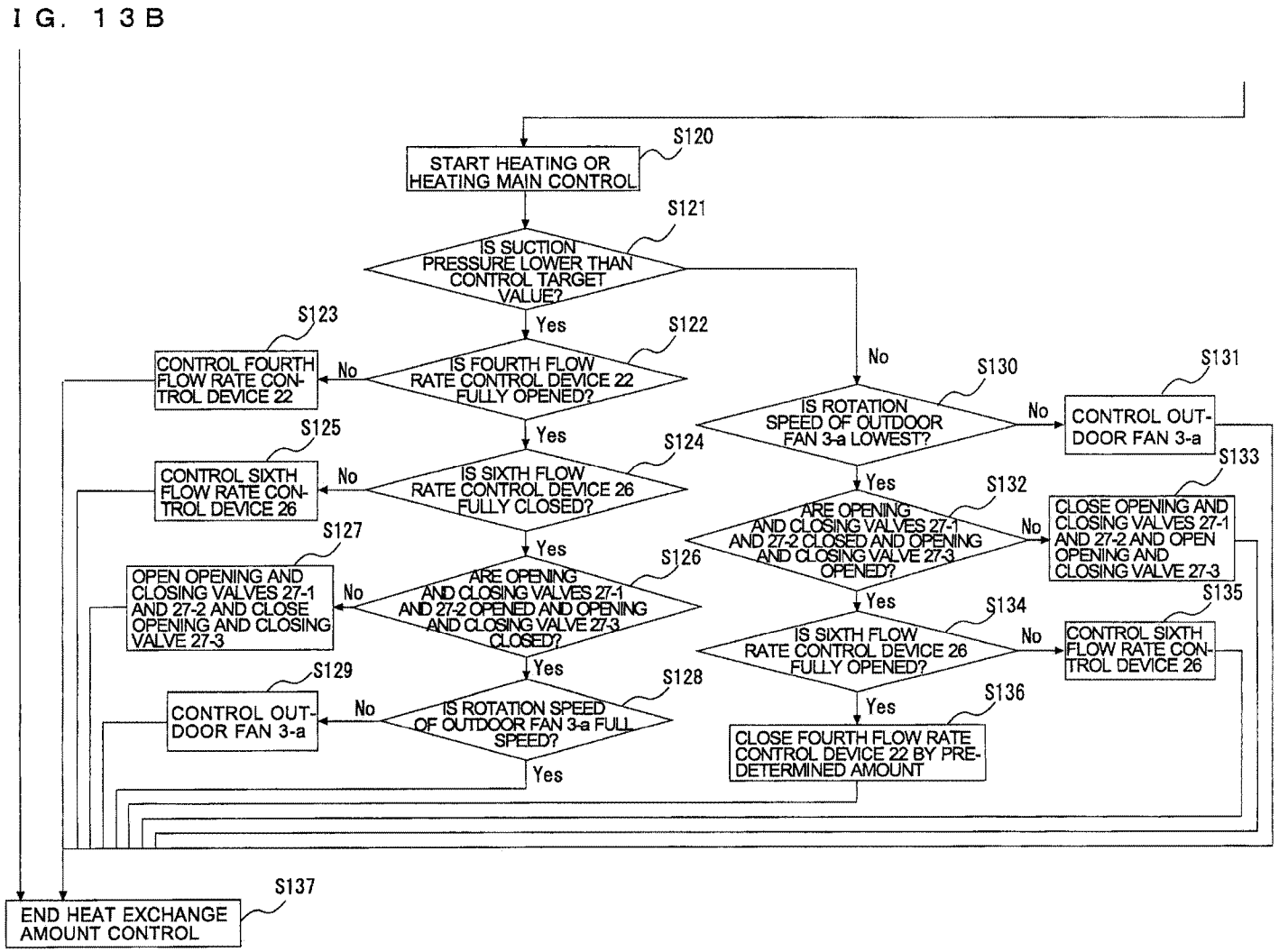
Figure 14:
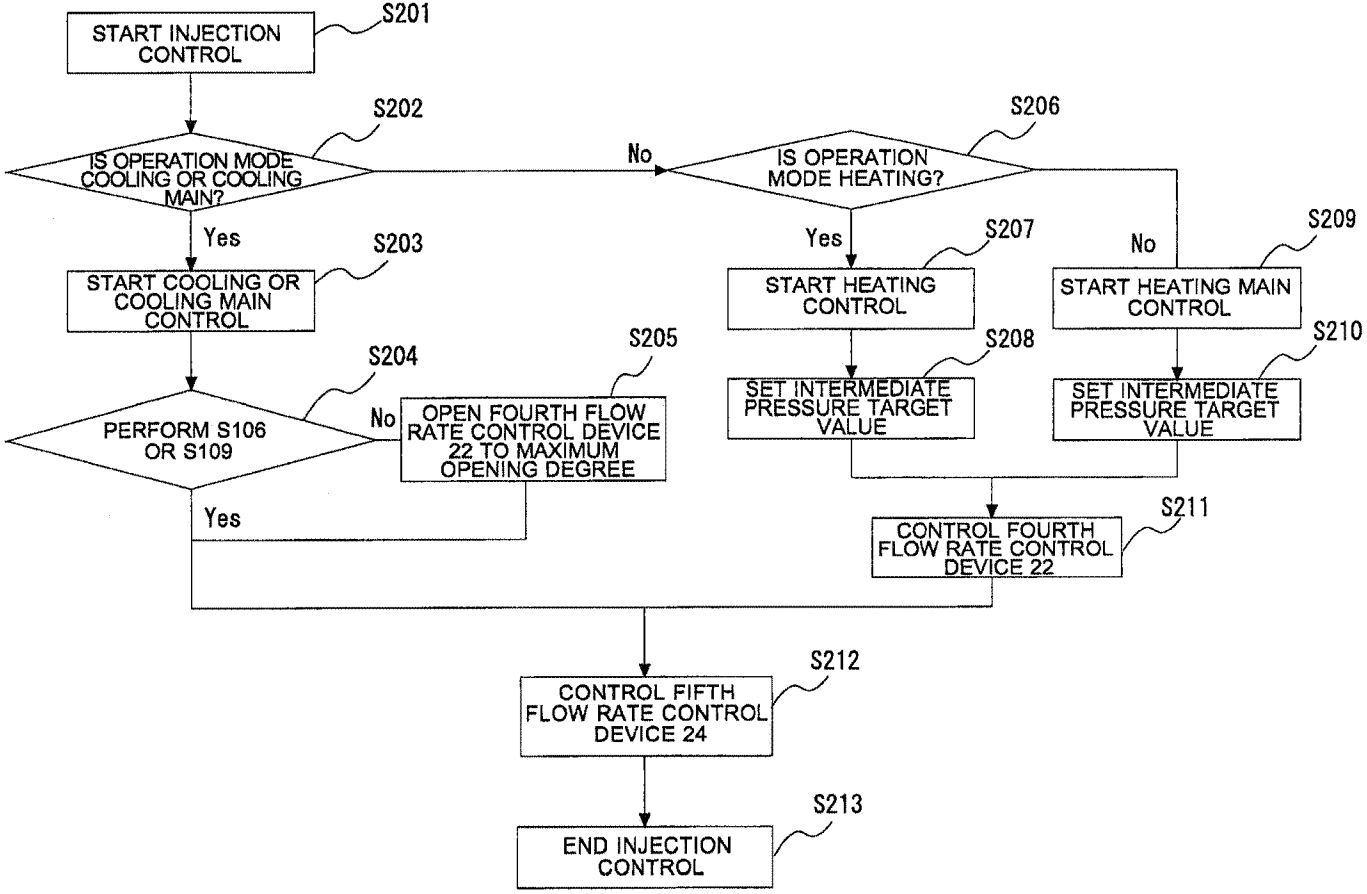
FIG. 14 is a flowchart illustrating the detailed control flow of the injection control performed by the air-conditioning apparatus according to Embodiment 1 of the present invention.
Figure 15:
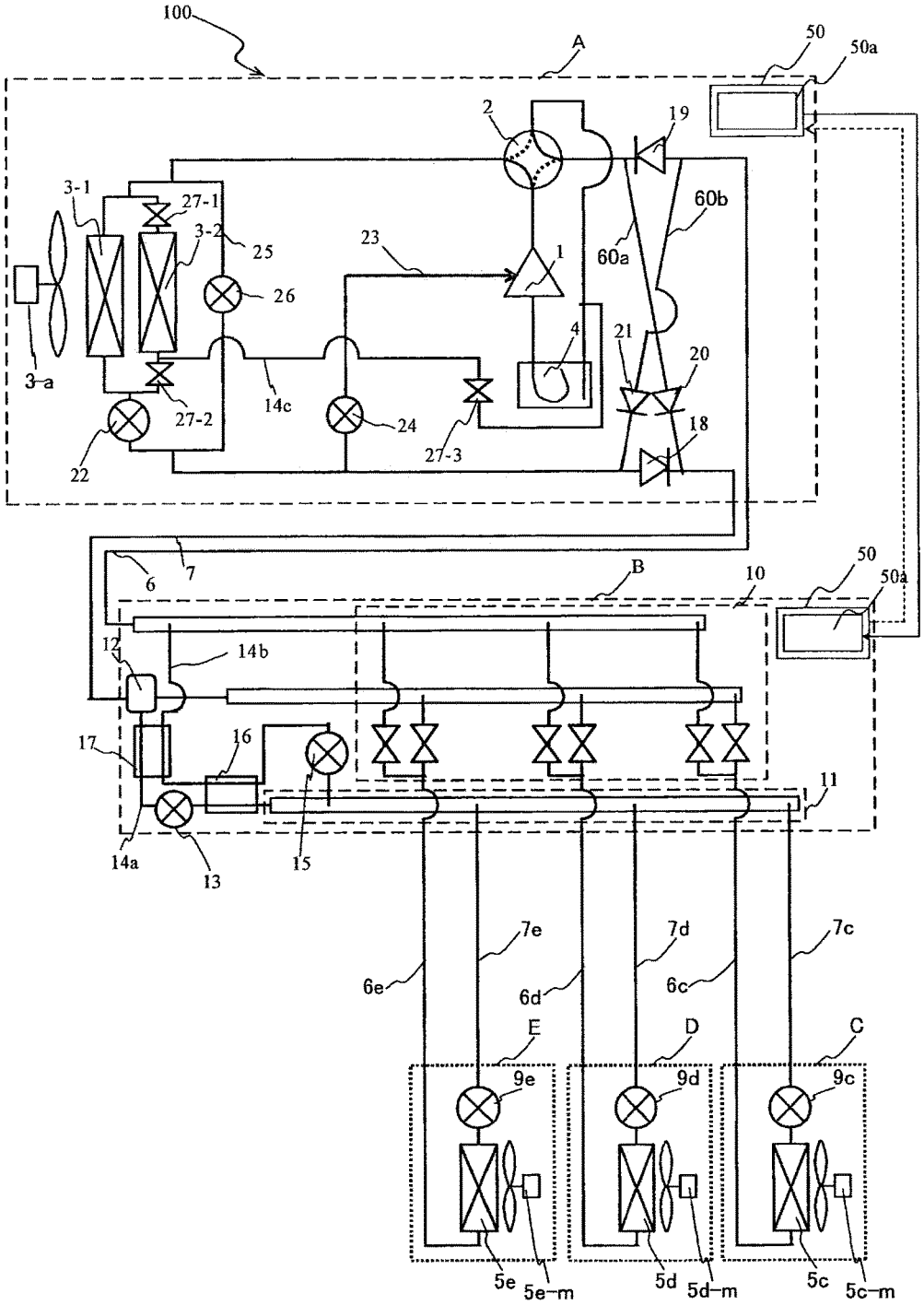
FIG. 15 is a refrigerant circuit diagram illustrating still another example of the refrigerant circuit configuration of the air-conditioning apparatus according to Embodiment 1 of the present invention.

FIG. 12 is a flowchart illustrating the control flow of heat exchange amount control of the outdoor heat exchanger 3 and injection control performed by the air-conditioning apparatus 100. FIG. 13 is a flowchart illustrating the detailed control flow of the heat exchange amount control of the outdoor heat exchanger 3. FIG. 14 is a flowchart illustrating the detailed control flow of the injection control. FIG. 15 is a refrigerant circuit diagram illustrating another example of the refrigerant circuit configuration of the air-conditioning apparatus 100. The heat exchange amount control of the outdoor heat exchanger 3 and the injection control performed by the air-conditioning apparatus 100 will be explained with reference to FIGS. 12 to 15.

The heat exchange amount control of the outdoor heat exchanger 3 will be explained first with reference to FIGS. 12 and 13. When the air-conditioning apparatus 100 starts operation (step S1 in FIG. 12), the controller 50 performs the heat exchange amount control of the outdoor heat exchanger 3 (step S2 in FIG. 12, and step S101 in FIG. 13). The amount of heat exchange of the outdoor heat exchanger 3 is controlled using the outdoor fan 3-*a*, opening and closing valves 27-1, 27-2, and 27-3 arranged at the input and output of the outdoor heat exchanger 3 illustrated in FIG. 15 (to be described later), the sixth flow rate control device 26, and the fourth flow rate control device 22.

The controller 50 determines the currently selected operation mode (step S102 in FIG. 13). Then, the controller 50 starts control corresponding to the selected operation mode (step S103 and step S121 in FIG. 13). When a cooling operation or cooling main operation mode is selected, the controller 50 starts to control each individual actuator on the basis of the discharge pressure (steps S104 to S119 in FIG. 13). In contrast, when a heating operation or heating main operation mode is selected, the controller 50 starts to control each individual actuator on the basis of the suction pressure (steps S121 to S136 in FIG. 13).

In steps S105 to S112, steps S113 to S119, steps S121 to S129, and steps S130 to S136 in FIG. 13, the order of priority of actuators for which control values are to be changed may be changed. However, by setting a target value for the discharge pressure or suction pressure and applying a given gain to the difference from the current value, the control value for each actuator need only be changed. Furthermore, changes for two or more actuators may be made at the same time.

Furthermore, if the flow rate control of the outdoor heat exchanger 3 is performed during a cooling operation or a cooling main operation when the outside air has a low temperature, a large amount of liquid refrigerant exists in a heat transfer pipe of the outdoor heat exchanger 3, which may cause a shortage of refrigerant in the entire refrigerant circuit. Thus, the inlet and outlet of refrigerant of the outdoor heat exchanger 3 can be divided into a plurality of parts, the opening and closing valves 27-1 and 27-2 can be arranged at the input and output of an outdoor heat exchanger 3-2, and a bypass pipe 14*c* and an opening and closing valve 27-3 for draining the refrigerant from the outdoor heat exchanger 3-2 into the accumulator 4 can be arranged, as illustrated in FIG. 15. When it is determined that the refrigerant within the circuit has run short, the refrigerant stored within the outdoor heat exchanger 3-2 can be supplied into the refrigerant circuit upon closing the opening and closing valves 27-1 and 27-2 and opening the opening and closing valve 27-3.

The sixth flow rate control device 26 performs bypass control when the amount of heat exchange in the outdoor heat exchanger 3 is excess, and even if the opening and closing valves 27-1 and 27-2 are closed, the amount of heat exchange in the outdoor heat exchanger 3 does not become insufficient. Furthermore, in the case of a heating operation or a heating main operation, since a small amount of refrigerant is required for driving the cycle, there is no need to halve the outdoor heat exchanger 3. Therefore, steps S126, S127, S132, and S133 in FIG. 13 may be skipped at the time of controlling the actuators.

Injection control to improve the heating capacity and to lower the discharge temperature will be explained next with reference to FIGS. 12 and 14. When the controller 50 ends the heat exchange amount control of the outdoor heat exchanger 3 (step S137), it performs injection control (step S3 in FIG. 12 and step S201 in FIG. 14).

First, in order to perform injection, the pressure of the injection pipe 23 needs to be higher than the pressure in the compression chamber of the compressor 1. In the case of a cooling operation or a cooling main operation, since the pressure of refrigerant flowing into the fifth flow rate control device 24 at the injection pipe 23 is substantially equal to the discharge pressure, there is no need to control the intermediate pressure. Therefore, it is only necessary to fully open the fourth flow rate control device 22 (steps S202 to S205 in FIG. 14). However, in the case where the fourth flow rate control device 22 is controlled for the heat exchange amount control of the outdoor heat exchanger 3, its opening degree is maintained.

In contrast, in the case of a heating operation or a heating main operation, upon fully opening the fourth flow rate control device 22, the intermediate pressure becomes substantially equal to the suction pressure. Therefore, there is a possibility that required injection cannot be performed. Thus, during a heating operation, the fourth flow rate control device 22 need only be operated so that the intermediate pressure has a predetermined value (for example, the pressure difference from the discharge pressure is about 15 degrees Centigrade when the pressure difference is converted into a saturation temperature), and during a heating main operation, the intermediate-pressure saturation temperature becomes 0 degrees Centigrade to 5 degrees Centigrade when the intermediate-pressure saturation temperature is converted into a saturation temperature in consideration of the fact that an indoor unit performs cooling at this time (steps S206 to S211 in FIG. 14).

Next, for example, in the case where the discharge temperature of the compressor 1 (the measurement value obtained by the thermometer 54) has reached a predetermined value (for example, 110 degrees Centigrade or above), the fifth flow rate control device 24 is operated to perform discharge temperature control by injection (step S212 in FIG. 14). At this time, the discharge temperature need only be controlled so that the difference between the discharge temperature and the condensing temperature falls within the range of, for example, 20 degrees Centigrade to 50 degrees Centigrade. End injection control is performed in step S213.

Figure 16:
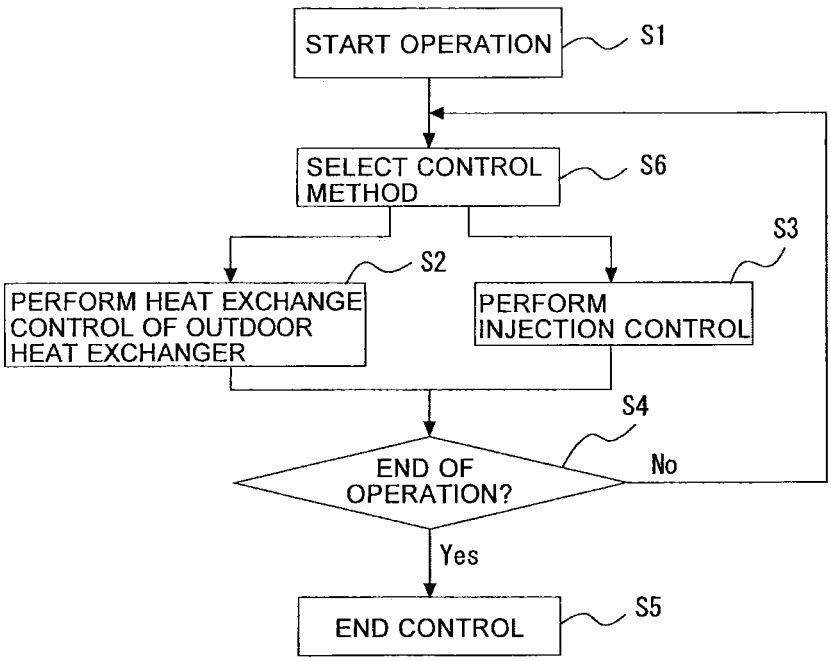
FIG. 16 is a flowchart illustrating a control flow in selecting a control method for the air-conditioning apparatus according to Embodiment 1 of the present invention.

The circumstances in which heat exchange amount control of the outdoor heat exchanger 3 and injection control occur will now be discussed. FIG. 16 is a flowchart illustrating a control flow in selecting in step S6 a control method for the air-conditioning apparatus 100. On condition that the outdoor fan 3-*a* does not need to be operated at full speed depending on the indoor load conditions and outside air temperature conditions, the heat exchange amount control of the outdoor heat exchanger 3 is required. At this time, the compression ratio is low, and the discharge temperature is not very high. In a heating operation and a heating main operation as well, since the outside air has a high temperature, there is no need to increase the heating capacity, and therefore no need for injection.

In contrast, on condition that the compression ratio is high, injection is required. The outdoor fan 3-*a* operates at full speed, the sixth flow rate control device 26 is fully closed, and the compression ratio is controlled to be as low as possible. From the above, according to the indoor load conditions and the outside air temperature conditions, the control method may be switched between the heat exchange amount control of the outdoor heat exchanger 3 and the injection control, as illustrated in FIG. 16.

TABLE 1

| Determination conditions | | |
|---|---|---|
| | Operation mode | Control method |
| Cooling | Outside air temperature is $x_1$ degrees Centigrade or above | Injection control |
| | Outside air temperature is below $x_1$ degrees Centigrade | Heat exchange amount control of outdoor heat exchanger 3 |
| | Cooling main | Heat exchange amount control of outdoor heat exchanger 3 |
| Heating | Outside air temperature is $x_2$ degrees Centigrade or above | Heat exchange amount control of outdoor heat exchanger 3 |
| | Outside air temperature is below $x_2$ degrees Centigrade | Injection control |
| Heating main | Outside air temperature is $x_3$ degrees Centigrade or above | Heat exchange amount control of outdoor heat exchanger 3 |
| | Outside air temperature is below $x_3$ degrees Centigrade | Injection control |

Table 1 shows an example of a determination method in the case where the control method is changed according to the outside air temperature. During a cooling operation, the threshold $x_1$ [degrees Centigrade] of the outside air temperature is set to fall within the range of 30 degrees Centigrade to 40 degrees Centigrade. In the case where as one piece of operation data, the outside air temperature is high and the discharge pressure of the cycle is high, it is determined that the discharge temperature is high, and injection control can thus be performed. In the other cases, the heat exchange amount control of the outdoor heat exchanger 3 can be performed. Since it is supposedly rare for an indoor unit to perform heating in the state where the outside air temperature exceeds 30 degrees Centigrade, the heat exchange amount control of the outdoor heat exchanger 3 need only be performed during a cooling main operation.

In contrast, during a heating or heating main operation, each of $x_2$ [degrees Centigrade] and $x_3$ [degrees Centigrade] is set to fall within the range of, for example, about 0 degrees Centigrade to 10 degrees Centigrade. In the case where the outside air temperature is high and the suction pressure is high, it is determined that the discharge temperature is low and the heating capacity is sufficient, and thus the outdoor heat exchanger 3 is desirably controlled. Furthermore, in the case where the outside air temperature is low and the suction pressure is low, it is determined that the discharge temperature is high and the heating capacity is insufficient, and thus injection control is desirably performed. By incorporating not only the outside air temperature but also the indoor load (the indoor temperature and the number of indoor units performing cooling and heating) and the pressure, temperature, and compressor frequency within the air-conditioning apparatus into determination criteria as operation data, more stable control can be performed. End of operation is determined in step S4 (FIGS. 12 and 16) and end of control is performed in step S5 (FIGS. 12 and 16).

As described above, with the air-conditioning apparatus 100, in any operation mode, the compressor 1 is able to operate with high reliability upon lowering the discharge temperature, and at the same time, perform an efficient operation corresponding to the indoor load.

Embodiment 2

Figure 17:
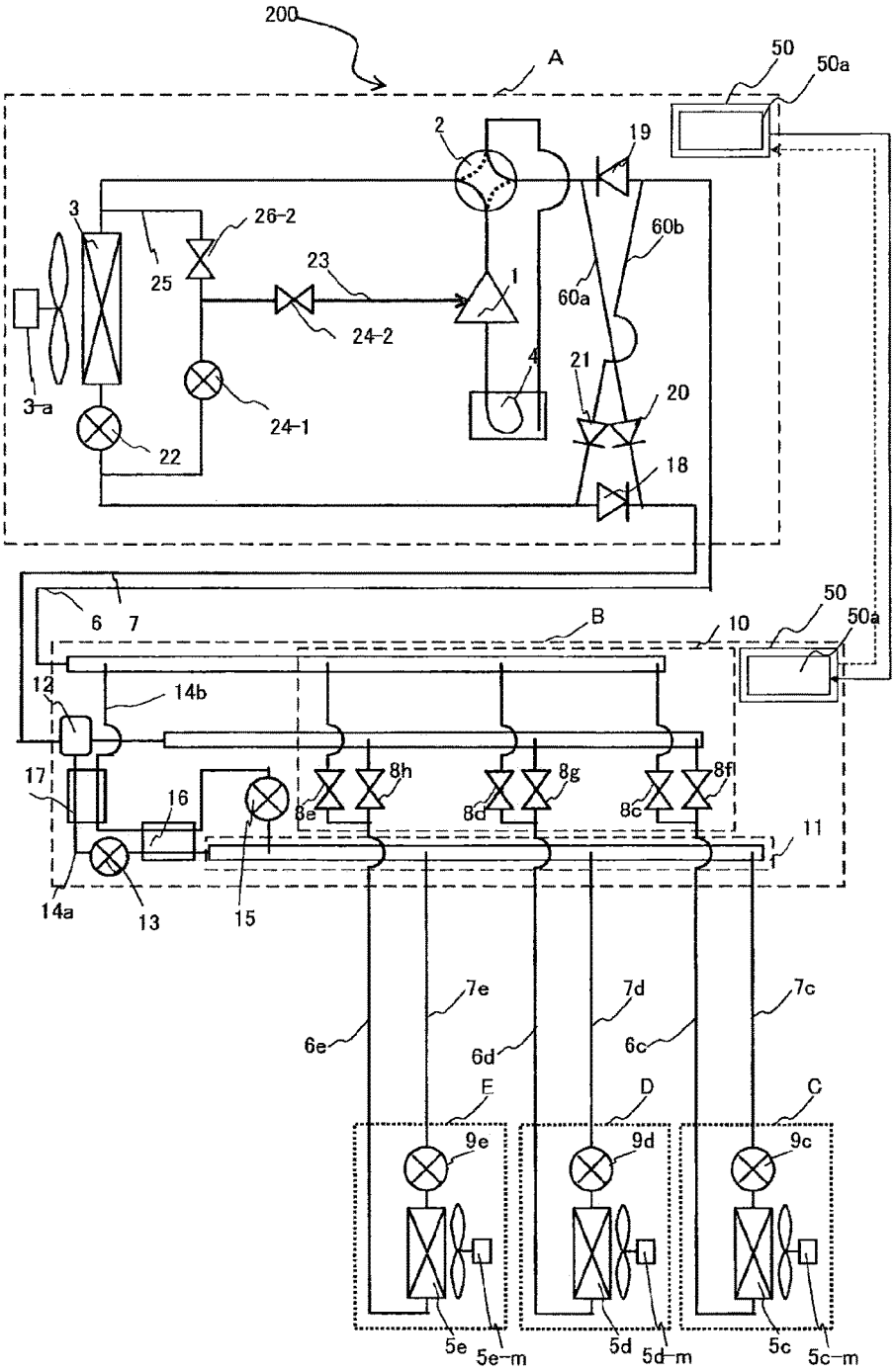
FIG. 17 is a schematic circuit configuration diagram illustrating an example of the refrigerant circuit configuration of an air-conditioning apparatus according to Embodiment 2 of the present invention.

FIG. 17 is a schematic circuit configuration diagram illustrating an example of the refrigerant circuit configuration of an air-conditioning apparatus 200 according to Embodiment 2 of the present invention. The air-conditioning apparatus 200 will be explained below with reference to FIG. 17. In Embodiment 2, differences from Embodiment 1 described above will be mainly explained, and an explanation for the same portions as those in Embodiment 1, such as the refrigerant circuit configuration, will be omitted. Furthermore, since individual operation modes executed by the air-conditioning apparatus 200 and control in the individual operation modes are similar to those in the air-conditioning apparatus 100 according to Embodiment 1, an explanation for the individual operation modes executed by the air-conditioning apparatus 200 and the control in the individual operation modes will be omitted.

The air-conditioning apparatus 200 is different from the air-conditioning apparatus 100 according to Embodiment 1 in terms of the configuration of an injection pipe 23 and a third bypass pipe 25 within an outdoor unit A. The air-conditioning apparatus 200 is configured to be capable of switchably performing heat exchange amount control of the outdoor heat exchanger 3 or injection flow rate control.

The injection pipe 23 is provided to inject an intermediate-pressure refrigerant into the compressor 1, similar to the injection pipe 23. However, unlike the injection pipe 23, the injection pipe 23 branches off from the third bypass pipe 25 and is connected to an injection port (not illustrated) of the compressor 1. The injection pipe 23 is provided with an opening and closing valve 24-2. By controlling opening and closing of the opening and closing valve 24-2, the flow rate of injection into the compressor 1 is controlled.

The third bypass pipe 25 is provided to allow bypassing of the outdoor heat exchanger 3. However, at the third bypass pipe 25, a flow rate control device 24-1 capable of controlling the bypass flow rate of the outdoor heat exchanger 3 and an opening and closing valve 26-2 are installed in parallel to the fourth flow rate control device 22.

As described above, similar to the air-conditioning apparatus 100 according to Embodiment 1, with the air-conditioning apparatus 200, in any operation mode, the compressor 1 is able to operate with high reliability upon lowering the discharge temperature, and at the same time, perform an efficient operation corresponding to the indoor load. Furthermore, with the air-conditioning apparatus 200, heat exchange amount control of the outdoor heat exchanger 3 and injection flow rate control can be switchably performed in accordance with the purpose of control.

Embodiment 3

Figure 18:
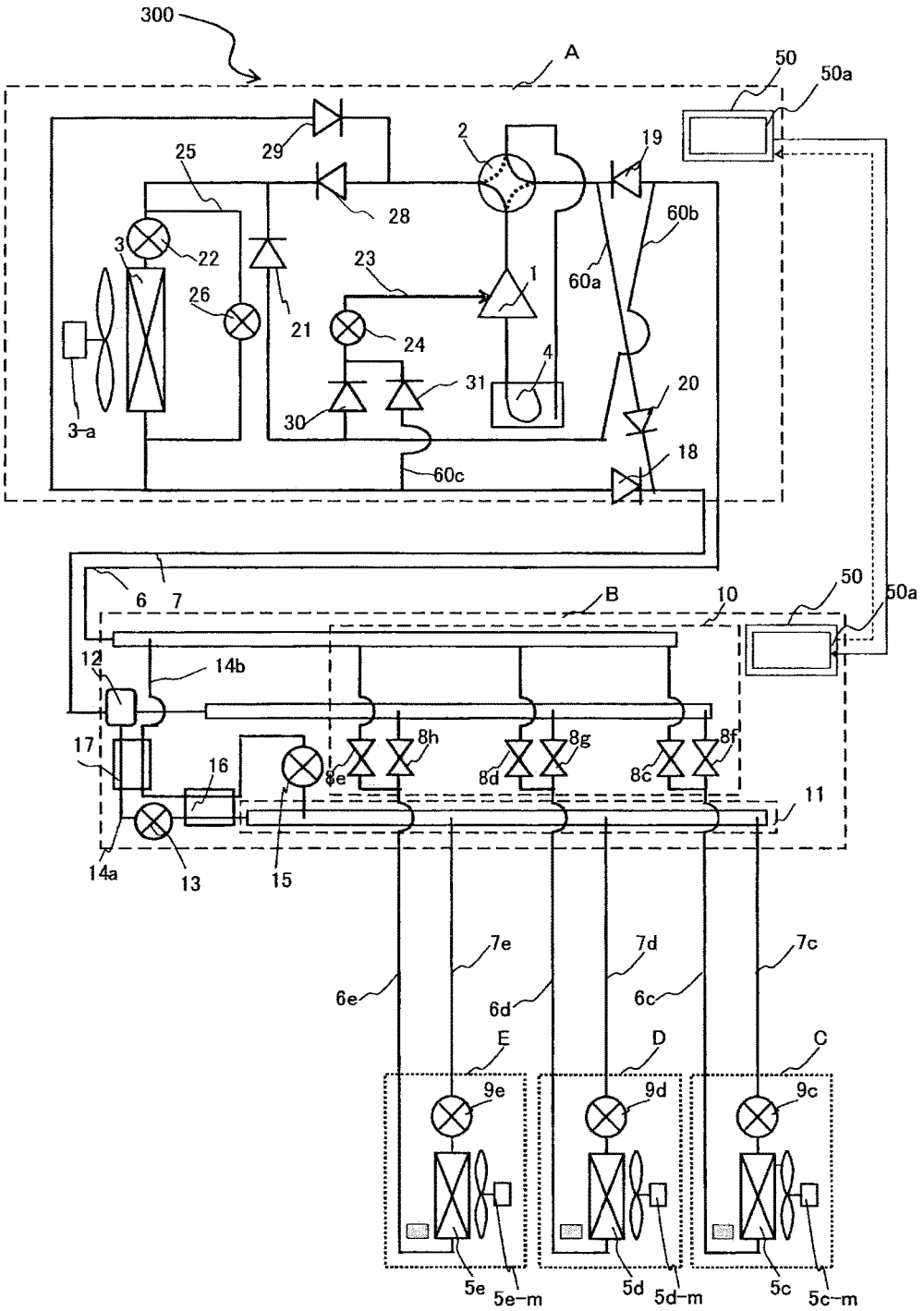
FIG. 18 is a schematic circuit configuration diagram illustrating an example of the refrigerant circuit configuration of an air-conditioning apparatus according to Embodiment 3 of the present invention.

FIG. 18 is a schematic circuit configuration diagram illustrating an example of the refrigerant circuit configuration of an air-conditioning apparatus 300 according to Embodiment 3 of the present invention. The air-conditioning apparatus 300 will be explained with reference to FIG. 18. In Embodiment 3, differences from Embodiment 1 and Embodiment 2 described above will be mainly explained, and an explanation for the same portions as those in Embodiments 1 and 2, such as the refrigerant circuit configuration, will be omitted. Furthermore, since individual operation modes executed by the air-conditioning apparatus 300 and control in the individual operation modes are similar to those in the air-conditioning apparatus 100 according to Embodiment 1, an explanation for the individual operation modes executed by the air-conditioning apparatus 300 and the control in the individual operation modes will be omitted.

The air-conditioning apparatus 300 is different from the air-conditioning apparatus 100 according to Embodiment 1 in that the direction in which a refrigerant flows into an outdoor heat exchanger 3 of an outdoor unit A is fixed in one direction in all the operation modes: cooling, cooling main, heating, and heating main. Accordingly, the positions where a fourth flow rate control device 22 and a check valve 21 are placed are different from the air-conditioning apparatus 100 according to Embodiment 1. Furthermore, the air-conditioning apparatus 300 is different from the air-conditioning apparatus 100 according to Embodiment 1 in that check valves 28, 29, 30, and 31 are provided.

Furthermore, a second connecting pipe 60*b* is connected between the check valve 28 and the fourth flow rate control device 22. In addition, a second refrigerant pipe 7 is connected between the position between a four-way switching valve 2 and the check valve 28, and the position between the outdoor heat exchanger 3 and a check valve 18. Moreover, an injection pipe 23 is configured to connect the second connecting pipe 60*b* to the injection port for the compressor 1. The second refrigerant pipe 7 on the upstream side of the check valve 18 is connected via a pipe 60*c* to the injection pipe 23 positioned between the check valve 30 and a fifth flow rate control device 24.

The fourth flow rate control device 22 is connected to one pipe led from the outdoor heat exchanger 3 that is different from the other pipe connected to the check valve 18 (on the downstream side of the outdoor heat exchanger). The check valve 28 is placed between a four-way switching valve 2 and the fourth flow rate control device 22 and is configured to allow the refrigerant to circulate only from the four-way switching valve 2 to the fourth flow rate control device 22. The check valve 21 is placed at the second connecting pipe 60*b* connected between the check valve 28 and the fourth flow rate control device 22 and is configured to allow the refrigerant to circulate only from a first refrigerant pipe 6 to the fourth flow rate control device 22. The check valve 29 is placed at the second refrigerant pipe 7 which connects the position between the four-way switching valve 2 and the check valve 28, and the position between the outdoor heat exchanger 3 and the check valve 18, and is configured to allow the refrigerant to circulate only from the downstream side of the outdoor heat exchanger 3 to the four-way switching valve 2.

At the injection pipe 23 on the upstream side of the fifth flow rate control device 24, the check valve 30 is installed. The check valve 30 is configured to allow the refrigerant to circulate only from the first refrigerant pipe 6 to the injection pipe 23 for the purpose of injection during a heating or heating main operation. At the pipe 60*c* on the upstream side of the fifth flow rate control device 24, the check valve 31 is installed. The check valve 31 is configured to allow the refrigerant to circulate only from the downstream side of the outdoor heat exchanger 3 to the injection pipe 23 for the purpose of injection during a cooling or cooling main operation.

With this arrangement, the air-conditioning apparatus 300 is capable of causing the refrigerant within the outdoor heat exchanger 3 to flow in one direction. Furthermore, by opposing the flow of refrigerant and the flow of air to each other, regardless of the operation mode, an efficient operation can be performed in the state where the difference in temperature between the air and the refrigerant is small. The effect of operating the flow of refrigerant to form counter flow, regardless of whether the outdoor heat exchanger 3 serves as a condenser or an evaporator, is great especially in the case of a refrigerant mixture by which a temperature gradient occurs due to non-azeotropic properties.

Figure 19:
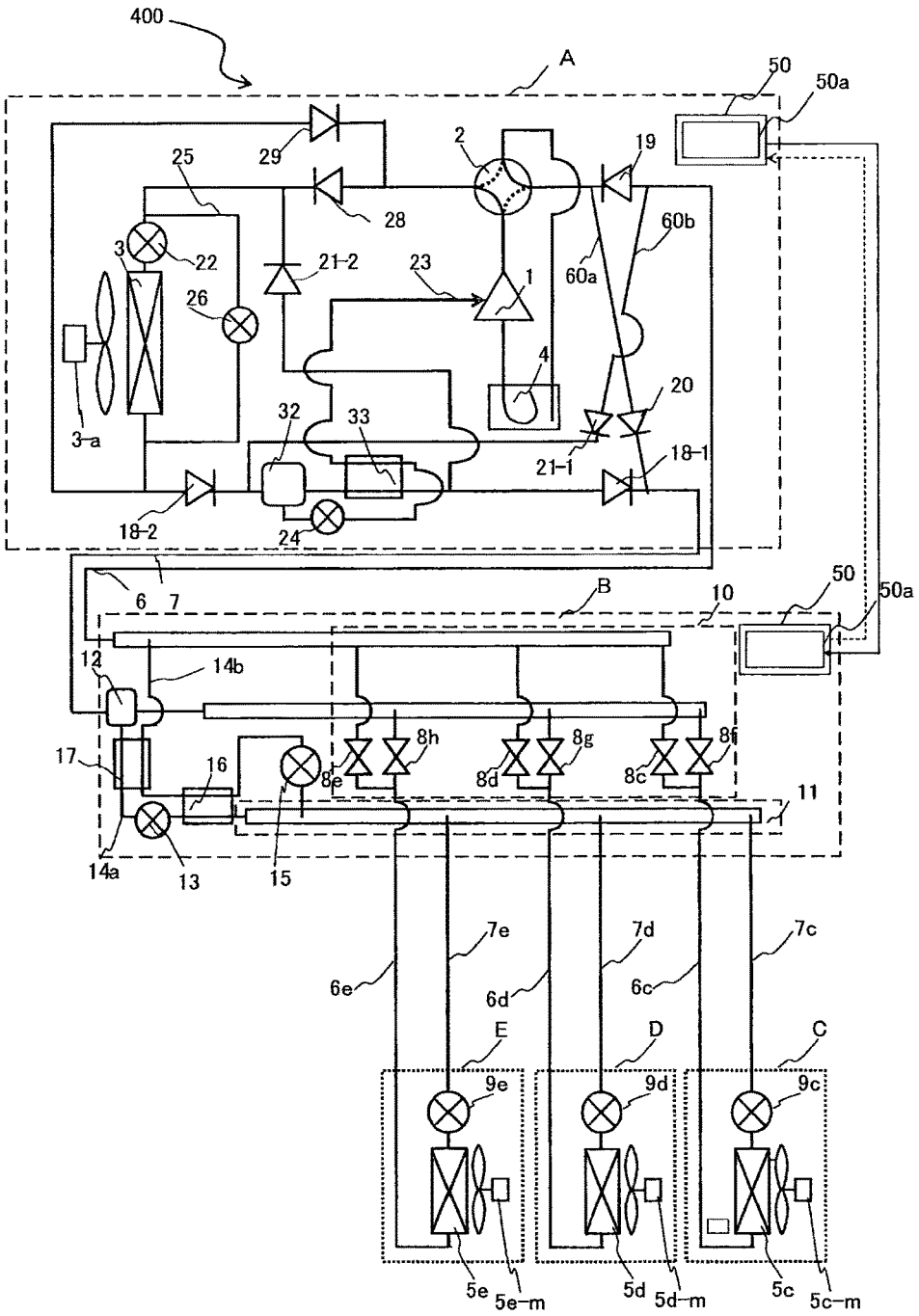
FIG. 19 is a schematic circuit configuration diagram illustrating another example of the refrigerant circuit configuration of the air-conditioning apparatus according to Embodiment 4 of the present invention.

FIG. 19 is a schematic circuit configuration diagram illustrating another example of the refrigerant circuit configuration of an air-conditioning apparatus 400 according to Embodiment 4 of the present invention. The air-conditioning apparatus 400 will be explained with reference to FIG. 19. Since individual operation modes executed by the air-conditioning apparatus 100 and control in the individual operation modes are similar to those in the air-conditioning apparatus 100 according to Embodiment 1, an explanation for the individual operation modes executed by the air-conditioning apparatus 100 and the control in the individual operation modes will be omitted.

The air-conditioning apparatus 400 includes check valves 18-1 and 18-2 connected in series and check valves 21-1 and 21-2, which correspond to the check valve 18 and the check valve 21, respectively, of the air-conditioning apparatus 300. In the air-conditioning apparatus 400, a pipe connecting between the check valves 18-1 and 18-2 is merged with a pipe connecting between the check valves 21-1 and 21-2. Furthermore, in the air-conditioning apparatus 400, a gas-liquid separator 32 and a third heat exchanger 33 are arranged, similar to the configuration illustrated in FIG. 11.

With this arrangement, in the air-conditioning apparatus 400, by a reliable decrease in discharge temperature and an improvement in evaporator capacity, the cooling and heating performance improves.

As described above, similar to the air-conditioning apparatus 100 according to Embodiment 1, with the air-conditioning apparatus according to Embodiment 4, in any operation mode, the compressor 1 is able to operate with high reliability upon lowering the discharge temperature, and at the same time, perform an efficient operation corresponding to the indoor load. Furthermore, the air-conditioning apparatus according to Embodiment 3 is able to perform an operation corresponding to the circuit configuration.

Embodiment 5

Figure 20:
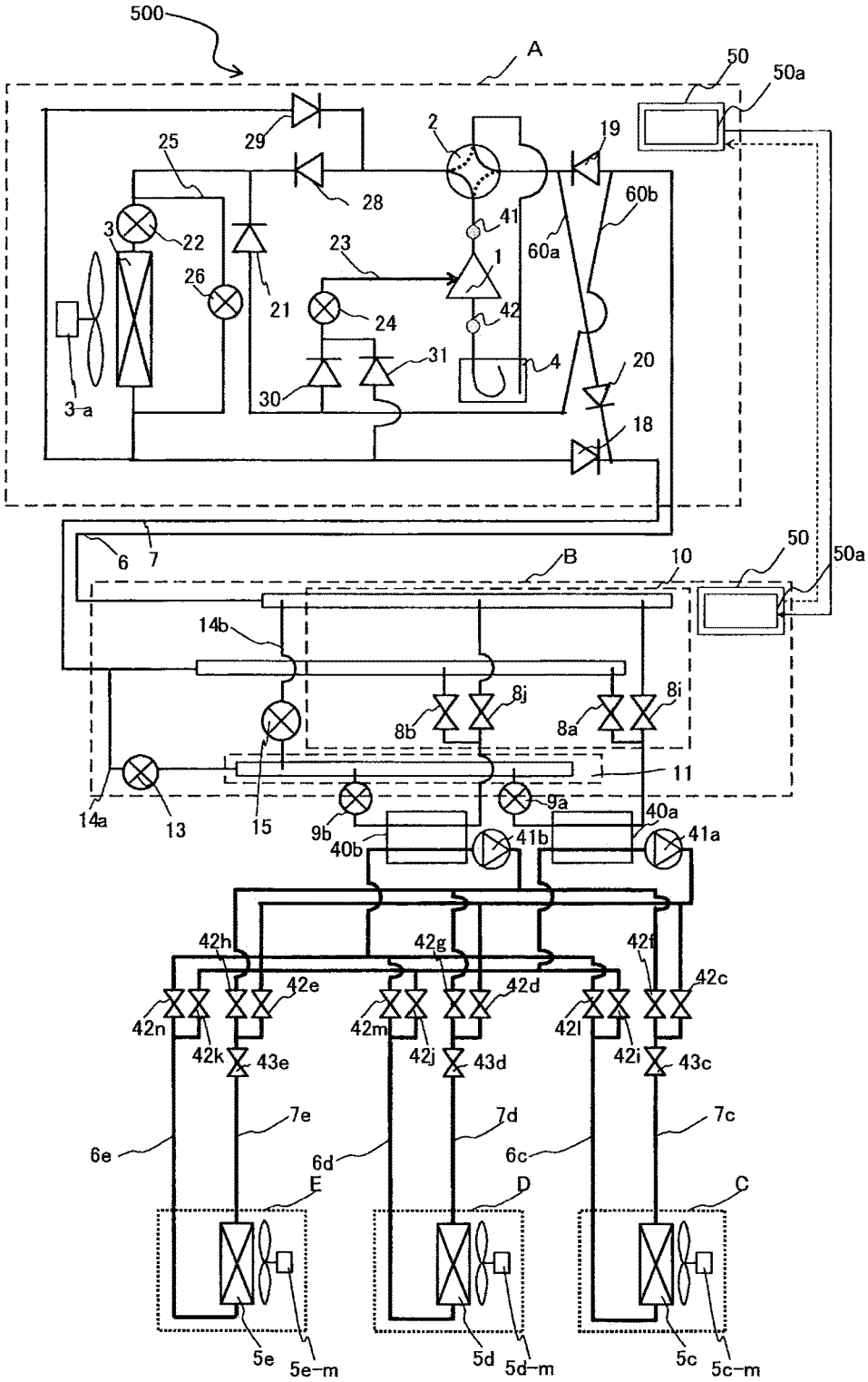
FIG. 20 is a schematic circuit configuration diagram illustrating an example of the refrigerant circuit configuration of an air-conditioning apparatus according to Embodiment 5 of the present invention.

FIG. 20 is a schematic circuit configuration diagram illustrating an example of the refrigerant circuit configuration of an air-conditioning apparatus 500 according to Embodiment 4 of the present invention. The air-conditioning apparatus 500 will be explained with reference to FIG. 20. In Embodiment 5, differences from Embodiments 1 to 4 described above will be mainly explained, and an explanation for the same portions as those in Embodiments 1 to 4, such as the refrigerant circuit configuration, will be omitted. Furthermore, since individual operation modes executed by the air-conditioning apparatus 500 and control in the individual operation modes are similar to those in the air-conditioning apparatus 100 according to Embodiment 1, an explanation for the individual operation modes executed by the air-conditioning apparatus 500 and the control in the individual operation modes will be omitted.

In the air-conditioning apparatus 500, intermediate heat exchangers 40*a* and 40*b* are installed in a relay unit B. In each of the intermediate heat exchangers 40*a* and 40*b*, the refrigerant exchanges heat with a second refrigerant driven by pumps 41*a* and 41*b* to generate hot water or cold water. As the second refrigerant, antifreeze (brine), water, a liquid mixture of antifreeze and water, a liquid mixture of water and an additive having a high anti-corrosion effect, or the like is used. The second refrigerant flows along portions indicated by thick lines in the drawing. That is, in the air-conditioning apparatus 500, two refrigerant circuits are configured such that heat exchange is performed at the intermediate heat exchangers 40*a* and 40*b*.

Heat transport from the intermediate heat exchangers 40*a* and 40*b* in the relay unit B to indoor units C to E is performed using brine. That is, brine is supplied from the relay unit B to the indoor units C to E via second indoor-unit-side refrigerant pipes 7*c* to 7*e*, cooling or heating is performed, and brine returns to the relay unit B via first indoor-unit-side refrigerant pipes 6*c* to 6*e*. Since the density of brine in the second indoor-unit-side refrigerant pipes 7*c* to 7*e* is substantially equal to that of brine in the first indoor-unit-side refrigerant pipes 6*c* to 6*e*, their widths may be the same.

Furthermore, the relay unit B is provided with solenoid valves 42*c* to 42*h* for selecting connection between the second indoor-unit-side refrigerant pipes 7*c* to 7*e* for the indoor units C to E and the intermediate heat exchangers 40*a* and 40*b*. The relay unit B is further provided with solenoid valves 42*i* to 42*n* for selecting connection between the first indoor-unit-side refrigerant pipes 6*c* to 6*e* for the indoor units C to E and the intermediate heat exchangers 40*a* and 40*b*. Flow rate control devices 43*c* to 43*e* that adjust the flow rates of brine flowing into the indoor units C to E are interposed between the solenoid valves 42*c* to 42*h* and the indoor units C to E.

Although the case where two intermediate heat exchangers 40*a* and 40*b* are provided will be taken as an example hereinafter, the number of intermediate heat exchangers is not limited to this. Any number of intermediate heat exchangers may be installed as long as a second refrigerant is able to be cooled and/or heated. Furthermore, neither the number of pumps 41*a* nor the number of pumps 41*b* is limited to one. A plurality of small-capacity pumps may be used by arranging them in parallel or series.

With the air-conditioning apparatus 500, in the case of a cooling operation in which all the indoor units C to E perform cooling, the intermediate heat exchangers 40*a* and 40*b* operate as evaporators to generate cold water. Regarding a P-h diagram on the refrigeration cycle side at this time, the case where injection is not performed is illustrated in FIG. 3, and the case where injection is performed is illustrated in FIG. 4. Furthermore, with the air-conditioning apparatus 500, in the case of a heating operation in which all the indoor units C to E perform heating, the intermediate heat exchangers 40*a* and 40*b* operate as radiators to generate hot water. Regarding a P-h diagram on the refrigeration cycle side at this time, the case where injection is not performed is illustrated in FIG. 5, and the case where injection is performed is illustrated in FIG. 6.

Furthermore, with the air-conditioning apparatus 500, in the case where the indoor units C to E perform cooling and heating simultaneously, one of the intermediate heat exchangers 40*a* and 40*b* operates as an evaporator to generate cold water and the other of the intermediate heat exchangers 40*a* and 40*b* operates as a condenser to generate hot water. At this time, based on the ratio of cooling load to heating load, connection of the four-way switching valve 2 is switched, the outdoor heat exchanger 3 is allowed to selectively serve as an evaporator or a radiator, and a cooling main operation or a heating main operation is performed. Regarding a P-h diagram on the refrigeration cycle side at this time, the case where injection is not performed during a cooling main operation is illustrated in FIG. 7, the case where injection is performed during a cooling main operation is illustrated in FIG. 8, the case where injection is not performed during a heating main operation is illustrated in FIG. 9, and the case where injection is performed during a heating main operation is illustrated in FIG. 10. The operation on the refrigeration cycle side is substantially the same as in Embodiments 1 and 3.

As described above, in the air-conditioning apparatus 500, the pumps 41*a* and 41*b*, indoor heat exchangers 5*c* to 5*e*, and the intermediate heat exchangers 40*a* and 40*b* are connected to form a circulation circuit through which a second refrigerant circulates, and the indoor heat exchangers 5*c* to 5*e* exchange heat between the second refrigerant and the indoor air. Therefore, with the air-conditioning apparatus 500, the refrigerant is prevented from flowing into an air-conditioned space even if the refrigerant leaks out of a pipe, thereby forming a safer configuration.

Furthermore, according to Embodiments 1 to 4 described above, when heat transport from the relay unit B to the indoor units C to E is performed using a refrigerant, the first flow rate control devices 9*c* to 9*e* are placed in the vicinities of the indoor heat exchangers 5*c* to 5*e*. In contrast, in the case where heat transport is performed using brine as in Embodiment 5, the flow rate control devices 43*c* to 43*e* can be placed within the relay unit B, without causing the temperature of brine to be changed by pressure loss in the first indoor-unit-side refrigerant pipes 6*c* to 6*e* and the second indoor-unit-side refrigerant pipes 7*c* to 7*e*, both serving as brine pipes. By placing the flow rate control devices 43*c* to 43*e* within the relay unit B and performing control of the difference in temperature between going and returning of brine, since control valves, such as the flow rate control devices 43*c* to 43*e*, are spaced apart from an indoor air-conditioned space, noise to indoor units, such as a sound of driving of the control valves and a flow sound of refrigerant when passing through valves, can be reduced.

Furthermore, since flow rate control can be collectively performed by the relay unit B, the indoor units C to E need only control fans on the basis of the conditions of indoor remote control conditions, thermo-off, information indicating whether the outdoor unit is performing defrosting, or the like. Furthermore, since heat transport from the outdoor unit A to the relay unit B is performed using a refrigerant, a pump to be used for driving brine can be downsized, thereby reducing the conveyance power for brine and improving energy saving. Moreover, the discharge temperature of the compressor 1 can be lowered to allow the compressor 1 to operate with high reliability. Although the outdoor unit A has a circuit configuration conforming to the specifications of the air-conditioning apparatus 300 in the aforementioned example, the circuit configuration of the air-conditioning apparatus 100, 200, or 400 may be employed.

As described above, with the air-conditioning apparatus 500 according to Embodiment 5, similar to the air-conditioning apparatus 100 according to Embodiment 1, in any operation mode, the compressor 1 is able to operate with high reliability upon lowering the discharge temperature, and at the same time, perform an efficient operation corresponding to the indoor load.

Embodiment 6

Figure 21:
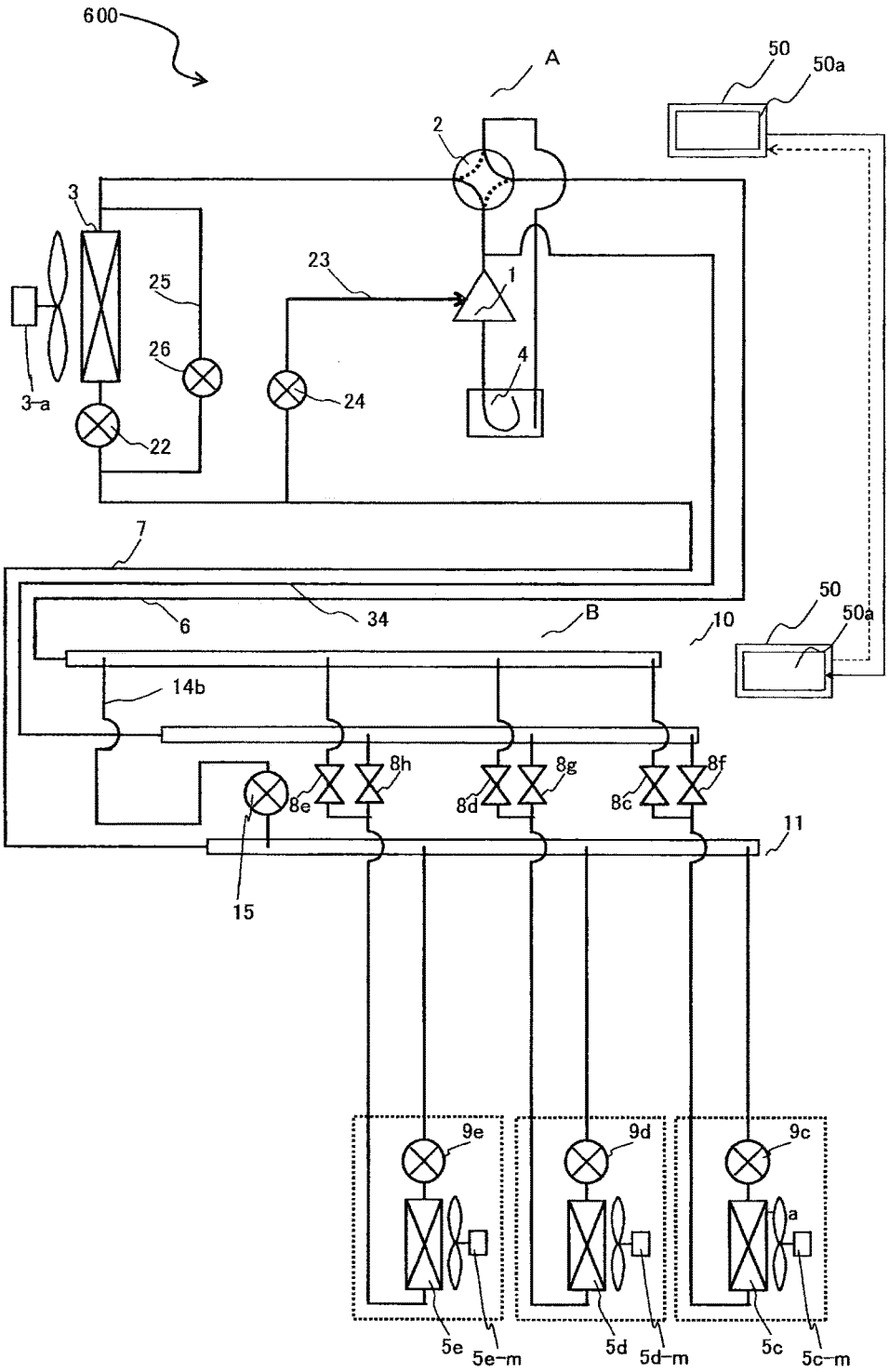
FIG. 21 is a schematic circuit configuration diagram illustrating an example of the refrigerant circuit configuration of an air-conditioning apparatus according to Embodiment 6 of the present invention.

FIG. 21 is a schematic circuit configuration diagram illustrating an example of the refrigerant circuit configuration of an air-conditioning apparatus 600 according to Embodiment 6 of the present invention. The air-conditioning apparatus 600 will be explained with reference to FIG. 21. In Embodiment 6, differences from Embodiments 1 to 5 described above will be mainly explained, and an explanation for the same portions as those in Embodiments 1 to 5, such as the refrigerant circuit configuration, will be omitted. Furthermore, since individual operation modes executed by the air-conditioning apparatus 600 and control in the individual operation modes are similar to those in the air-conditioning apparatus 100 according to Embodiment 1, an explanation for the individual operation modes executed by the air-conditioning apparatus 600 and the control in the individual operation modes will be omitted.

The air-conditioning apparatus 600 is different from the air-conditioning apparatuses according to Embodiments 1 to 5 in that the number of pipes connecting an outdoor unit A to a relay unit B is changed from two to three. A third refrigerant pipe 34 is installed so that a discharge pipe for a compressor 1 in the outdoor unit A and a first branch portion 10 in the relay unit B are connected together, and a second refrigerant pipe 7 is connected to a second branch portion 11. That is, the air-conditioning apparatus 600 is different from the air-conditioning apparatuses according to Embodiments 1 to 5 in that the refrigerant discharged from the compressor 1 is supplied via the third refrigerant pipe 34 to an indoor unit performing heating. Since the flow of refrigerant is substantially the same as the flow explained with reference to FIGS. 3 to 10 in Embodiment 1, an explanation for the flow of the refrigerant will be omitted.

As described above, similar to the air-conditioning apparatus 100 according to Embodiment 1, with the air-conditioning apparatus 600 according to Embodiment 6, in any operation mode, the compressor 1 is able to operate with high reliability upon lowering the discharge temperature, and at the same time, perform an efficient operation corresponding to the indoor load.

Although the cases where three indoor units are provided have been explained as examples in Embodiments 1 to 6, any number of indoor units may be connected. Furthermore, although the cases where the accumulator 4 is provided have been explained as examples in Embodiments 1 to 6, it need not necessarily be provided.

REFERENCE SIGNS LIST

1: compressor, 2: four-way switching valve, 3: outdoor heat exchanger, 3-1: outdoor heat exchanger, 3-2: outdoor heat exchanger, 3-*a*: flow rate control device (outdoor fan), 4: accumulator, 5: indoor heat exchanger, 5*c*: indoor heat exchanger, 5*d*: indoor heat exchanger, 5*e*: indoor heat exchanger, 5-*m*: flow rate control device (indoor fan), 5*c*-*m*: flow rate control device (indoor fan), 5*d*-*m*: flow rate control device (indoor fan), 5*e*-*m*: flow rate control device (indoor fan), 6: first refrigerant pipe, 6*c*: first indoor-unit-side refrigerant pipe, 6*d*: first indoor-unit-side refrigerant pipe, 6*e*: first indoor-unit-side refrigerant pipe, 7: second refrigerant pipe, 7*c*: second indoor-unit-side refrigerant pipe, 7*d*: second indoor-unit-side refrigerant pipe, 7*e*: second indoor-unit-side refrigerant pipe, 8*a*: solenoid valve, 8*b*: solenoid valve, 8*c*: solenoid valve, 8*d*: solenoid valve, 8*e*: solenoid valve, 8*f*: solenoid valve, 8*g*: solenoid valve, 8*h*: solenoid valve, 8*i*: solenoid valve, 8*j*: solenoid valve, 9: first flow rate control device, 9*c*: first flow rate control device, 9*d*: first flow rate control device, 9*e*: first flow rate control device, 10: first branch portion, 11: second branch portion, 12: gas-liquid separator, 13: second flow rate control device, 14*a*: first bypass pipe, 14*b*: second bypass pipe, 14*c*: bypass pipe, 15: third flow rate control device, 16: second heat exchanger, 17: first heat exchanger, 18: check valve, 18-1: check valve, 18-2: check valve, 19: check valve, 20: check valve, 21: check valve, 21-1: check valve, 21-2: check valve, 22: fourth flow rate control device (outdoor-side flow rate control device), 23: injection pipe, 24: fifth flow rate control device (injection flow rate control device), 24-1: flow rate control device, 24-2: opening and closing valve, 25: third bypass pipe, 26: sixth flow rate control device (bypass flow rate control device), 26-1: flow rate control device, 26-2: opening and closing valve, 27-1: opening and closing valve, 27-2: opening and closing valve, 27-3: opening and closing valve, 28: check valve, 29: check valve, 30: check valve, 31: check valve, 32: gas-liquid separator, 33: third heat exchanger, 34: third refrigerant pipe, 40*a*: intermediate heat exchanger, 40*b*: intermediate heat exchanger, 41*a*: pump, 41*b*: pump, 42*c*: solenoid valve, 42*d*: solenoid valve, 42*e*: solenoid valve, 42*f*: solenoid valve, 42*g*: solenoid valve, 42*h*: solenoid valve, 42*i*: solenoid valve, 42*j*: solenoid valve, 42*k*: solenoid valve, 421: solenoid valve, 42*m*: solenoid valve, 42*n*: solenoid valve, 43*c*: flow rate control device, 43*d*: flow rate control device, 43*e*: flow rate control device, 50: controller, 50*a*: memory, 51: pressure gauge, 52: pressure gauge, 53: pressure gauge, 54: thermometer, 60*a*: first connecting pipe, 60*b*: second connecting pipe, 60*c*: pipe, 100: air-conditioning apparatus, 200: air-conditioning apparatus, 300: air-conditioning apparatus, 400: air-conditioning apparatus, 500: air-conditioning apparatus, 600: air-conditioning apparatus, A: outdoor unit, B: relay unit, C: indoor unit, D: indoor unit, E: indoor unit.

The invention claimed is:

1. An air-conditioning apparatus comprising:

a compressor into which an intermediate-pressure refrigerant is allowed to be injected in the course of compressing a refrigerant;

an outdoor heat exchanger;

an indoor heat exchanger;

a first path through which the refrigerant flows from the indoor heat exchanger to the outdoor heat exchanger;

an injection pipe including a first end being connected to the compressor and a second end being connected to the first path;

a flow passage switching device configured to switch connection of the outdoor heat exchanger;

a second path connecting the flow passage switching device to the outdoor heat exchanger;

an injection flow rate control device configured to control a flow rate of injection into the compressor;

an outdoor-side flow rate control device configured to generate an intermediate pressure for injection into the compressor and that is able to change a flow passage resistance in a continuous manner;

a bypass pipe bypassing the outdoor heat exchanger and the outdoor-side flow rate control device;

a bypass flow rate control device provided to the bypass pipe in parallel to the outdoor-side flow rate control device being configured to change a flow passage resistance in a continuous manner, and being configured to control an amount of heat exchange of the outdoor heat exchanger together with the outdoor-side flow rate control device; and an indoor-side flow rate control device configured to adjust a flow rate of refrigerant to the indoor heat exchanger, wherein the compressor, the outdoor heat exchanger, the flow passage switching device, the injection flow rate control device, the outdoor-side flow rate control device, and the bypass flow rate control device are provided within an outdoor unit, wherein the indoor heat exchanger and the indoor-side flow rate control device are provided within an indoor unit, wherein the indoor unit includes a plurality of indoor units, which are connected to the outdoor unit in parallel, and wherein in accordance with an indoor load or an outside air temperature, one of control (a) and (b) is selectively performed:

(a) control of the amount of heat exchange of the outdoor heat exchanger by the outdoor-side flow rate control device and the bypass flow rate control device; and (b) control of the intermediate pressure by the outdoor-side flow rate control device, the bypass flow rate control device, and the injection flow rate control device, and control of the flow rate of injection into the compressor in which the bypass flow rate control device is closed.

2. The air-conditioning apparatus of claim 1, comprising a relay unit interposed between the outdoor unit and the indoor units, wherein the relay unit allows the indoor units to perform a cooling and heating mixed operation by switching a flow passage of the refrigerant so that cooling or heating is performed by each of the indoor units.

3. The air-conditioning apparatus of claim 2, wherein in an operation mode in which the outdoor heat exchanger operates as an evaporator, a target value for the intermediate pressure differs between a case where none of the indoor units are performing cooling and a case where at least one indoor unit is performing cooling.

4. The air-conditioning apparatus of claim 1, wherein in accordance with at least one piece of operation data out of the outside air temperature, an indoor temperature, the number of indoor units performing cooling and heating, and a pressure, a temperature, and a frequency of the compressor within the air-conditioning apparatus, switching is performed between the control of the amount of heat exchange of the outdoor heat exchanger and the control of the flow rate of injection into the compressor.

5. The air-conditioning apparatus of claim 1, wherein a direction in which the refrigerant flows within the outdoor heat exchanger is fixed in one direction, regardless of whether the outdoor heat exchanger operates as a condenser or an evaporator.

6. The air-conditioning apparatus of claim 1, wherein (a) the control of the amount of heat exchange of the outdoor heat exchanger is performed by continuously changing a flow rate of the refrigerant flowing into the outdoor heat exchanger.

7. The air-conditioning apparatus of claim 1, wherein as a refrigerant for a heat source, difluoromethane or a refrigerant mixture of tetrafluoropropane and 15 mass percent or more of difluoromethane is used.

8. The air-conditioning apparatus of claim 1, wherein the control of the flow rate of injection into the compressor is performed such that a discharge temperature of the refrigerant discharged from the compressor does not exceed 110 degrees Centigrade.

9. The air-conditioning apparatus of claim 1, wherein the outdoor-side flow rate control device and the bypass flow rate control device cooperate with each other to, based on the outside air temperature, switch between (a) the control of the amount of heat exchange of the outdoor heat exchanger, and (b) the control of the intermediate pressure and the control of the flow rate of injection into the compressor.

10. The air-conditioning apparatus of claim 1, further comprising:

a controller configured to control the injection flow rate control device, the outdoor-side flow rate control device, and the bypass flow rate control device, wherein the controller is configured to selectively perform (a) the control of the amount of heat exchange of the outdoor heat exchanger while closing the injection flow rate control device, and (b) the control of the intermediate pressure and the control of the flow rate of injection into the compressor.

11. The air-conditioning apparatus of claim 10, wherein the controller is configured to perform (b) the control of the intermediate pressure and the control of the flow rate of injection into the compressor while performing a heating operation in which the outdoor heat exchanger functions as a condenser and the indoor heat exchanger functions as an evaporator, and wherein the controller is configured not to perform (b) the control of the intermediate pressure and the control of the flow rate of injection into the compressor while performing a cooling operation in which the outdoor heat exchanger functions as the evaporator and the indoor heat exchanger functions as the condenser.

12. The air-conditioning apparatus of claim 10, wherein the controller is configured to perform (b) the control of the intermediate pressure and the control of the flow rate of injection into the compressor after performing (a) the control of the amount of heat exchange of the outdoor heat exchanger.

13. The air-conditioning apparatus of claim 10, wherein the indoor heat exchanger includes a first indoor heat exchanger and a second indoor heat exchanger, and the controller is configured to perform a heating operation in which the first indoor heat exchanger and the second indoor heat exchanger each function as a condenser and the outdoor exchanger functions as an evaporator, a cooling operation in which the first indoor heat exchanger and the second indoor heat exchanger each function as the evaporator and the outdoor exchanger functions as the condenser, a heating main operation in which the first indoor heat exchanger functions as the condenser, the second indoor heat exchanger and the outdoor exchanger each function as the evaporator, and a first load of the first indoor heat exchanger is larger than a second load of the second indoor heat exchanger, a cooling main operation in which the first indoor heat exchanger functions as the condenser, the second indoor heat exchanger and the outdoor exchanger each function as the evaporator, and a third load of the second indoor heat exchanger is larger than a fourth load of the first indoor heat exchanger.

14. The air-conditioning apparatus of claim 13, wherein the controller is configured to perform (b) the control of the intermediate pressure and the control of the flow rate of injection into the compressor while performing one of the heating operation and the heating main operation, and wherein the controller is configured not to perform (b) the control of the intermediate pressure and the control of the flow rate of injection into the compressor while performing one of the cooling operation and the cooling main operation.

15. The air-conditioning apparatus of claim 1, wherein (a) the control of the amount of heat exchange of the outdoor heat exchanger is performed by changing the flow passage resistance of the bypass flow rate control device while the refrigerant flows through the outdoor heat exchanger.

16. The air-conditioning apparatus of claim 1, wherein (a) the control of the amount of heat exchange of the outdoor heat exchanger includes a first state in which the bypass flow rate control device is closed and the outdoor-side flow rate control device is opened such that the refrigerant flows through the outdoor heat exchanger and does not flow through the bypass flow rate control device, and a second state in which the bypass flow rate control device and the outdoor-side flow rate control device are opened such that the refrigerant flows through the outdoor heat exchanger and the bypass flow rate control device.

17. The air-conditioning apparatus of claim 1, wherein the first path includes a first portion being connected to the injection pipe and a second portion being connected to the bypass pipe, the bypass pipe includes a first end being connected to the second path and a second end being connected to the second portion of the first path, and the second portion provided to between the outdoor-side flow rate control device and the first portion of the first path.

* * * * *